US009960520B2

(12) United States Patent
Sekino et al.

(10) Patent No.: US 9,960,520 B2
(45) Date of Patent: May 1, 2018

(54) CONNECTOR HAVING CONNECTOR CONSTITUENTS AND A LOCKED PORTION

(71) Applicant: YAZAKI CORPORATION, Minato-ku, Tokyo (JP)

(72) Inventors: Tetsuya Sekino, Shizuoka (JP); Nobuyuki Sakamoto, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days. days.

(21) Appl. No.: 14/871,413

(22) Filed: Sep. 30, 2015

(65) Prior Publication Data

US 2016/0020545 A1 Jan. 21, 2016

Related U.S. Application Data

(63) Continuation of application No. PCT/JP2014/059132, filed on Mar. 28, 2014.

(30) Foreign Application Priority Data

Apr. 1, 2013 (JP) ..... 2013-075881

(51) Int. Cl.
*H01R 13/502* (2006.01)
*H01R 13/627* (2006.01)
*H01R 4/24* (2018.01)

(52) U.S. Cl.
CPC ..... *H01R 13/502* (2013.01); *H01R 4/2433* (2013.01); *H01R 13/6275* (2013.01)

(58) Field of Classification Search
CPC . H01R 13/502; H01R 13/6275; H01R 4/2433
(Continued)

(56) References Cited

U.S. PATENT DOCUMENTS 4,802,861 A 2/1989 Gaston
4,872,736 A * 10/1989 Myers ..... G02B 6/3878 385/60
(Continued)

FOREIGN PATENT DOCUMENTS

EP 0975063 A1 1/2000
EP 2040339 A1 3/2009
(Continued)

OTHER PUBLICATIONS

Chinese Official Action dated Sep. 23, 2016 in the counterpart Chinese patent application.
(Continued)

*Primary Examiner* — Renee S Luebke
*Assistant Examiner* — Paul Baillargeon
(74) *Attorney, Agent, or Firm* — Metrolexis Law Group, PLLC

(57) ABSTRACT

A connector includes a first connector constituent including a first terminal and a locking portion; a second connector constituent including a second terminal and a locked portion, and configured so that the second terminal is joined to the first terminal when the second connector constituent is installed in the first connector constituent; and a third connector constituent including a locked-portion holding portion configured to keep the locked portion locked to the locking portion when the third connector constituent is installed over the second connector constituent installed in the first connector constituent.

10 Claims, 23 Drawing Sheets

(58) Field of Classification Search
USPC ..... 439/247, 248, 250–355, 357, 595, 871, 439/245, 246
See application file for complete search history.

(56) References Cited

U.S. PATENT DOCUMENTS

| | | | | |
|---|---|---|---|---|
| 6,056,577 | A | 5/2000 | Blanchet | |
| 6,159,019 | A * | 12/2000 | Norizuki | H01R 13/6315 174/72 A |
| 6,341,972 | B1 | 1/2002 | Odorfer | |
| 7,435,112 | B1 * | 10/2008 | Miller | H01R 13/502 439/133 |
| 7,513,788 | B2 * | 4/2009 | Camelio | H01R 13/6277 439/352 |
| 9,325,113 | B2 * | 4/2016 | Pankau | H01R 13/6272 |
| 2006/0086900 | A1 | 4/2006 | Nakamura | |
| 2010/0003841 | A1 | 1/2010 | Metzler et al. | |
| 2011/0034078 | A1 | 2/2011 | Nagata et al. | |

FOREIGN PATENT DOCUMENTS

| | | | |
|---|---|---|---|
| JP | H02-501340 | A | 5/1990 |
| JP | H04-078785 | U | 7/1992 |
| JP | H05-045949 | U | 6/1993 |
| JP | 2000-509194 | A | 7/2000 |
| JP | 2011-040225 | A | 2/2011 |
| JP | 2014-143160 | A | 8/2014 |
| WO | 1988/010525 | A1 | 12/1988 |
| WO | 1997/041623 | A1 | 11/1997 |

OTHER PUBLICATIONS

Japanese Official Action dated Oct. 4, 2016 in the counterpart Japanese patent application.
Chinese Official Action dated Mar. 16, 2017 in the counterpart Chinese patent application.

* cited by examiner

CONNECTOR HAVING CONNECTOR CONSTITUENTS AND A LOCKED PORTION

CROSS REFERENCE TO RELATED APPLICATION

This application is a Continuation of PCT Application No. PCT/JP2014/059132, filed on Mar. 28, 2014, and claims the priority of Japanese Patent Application No. 2013-075881, filed on Apr. 1, 2013, the content of both of which is incorporated herein by reference.

BACKGROUND

1. Technical Field

The disclosure relates to a connector and more particularly to a connector in which a pair of connector constituents joined together thereby is engaged with another connector constituent to provide an electrical connection between terminals.

2. Related Art

US 2010/0003841 A1 proposes a connector 501 of a first conventional example as illustrated in FIG. 23. The connector 501 of the first conventional example is high in cost, since contact components 503, 505, 507 coaxially arranged are dedicated components. Moreover, in the development of a structure using a crimp terminal to rotatably fit a wire harness side connector, the wire harness side connector needs to be constructed of at least two or more components. Further, a sensor side connector placed on a bottom surface of a hollow cylindrical structure cannot be seen during operation, and thus, it is necessary to ensure contact point side fitting.

The connector 501 of the first conventional example is high in cost because the contact components 503, 505, 507 have a multi-contact structure for purposes of measures against vibrations. In short, the connector 501 of the first conventional example poses problems of being complicated in construction to render it difficult to ensure fitting and consequently being expensive.

Japanese Patent Application No. 2012-280784 (filed on Dec. 25, 2012) proposes a connector 511 of a second conventional example as illustrated in FIG. 22. The connector 511 of a second conventional example has been proposed as a connector simple in construction and capable of easy operation for fitting housing portions together even if the counterpart side one of the housing portions cannot be clearly seen by visual observation.

The connector 511 of the second conventional example includes a wire harness side connector portion 515 having a first housing portion 513 in which a female terminal (not illustrated) is arranged, and a sensor side connector portion 521 having a second housing portion 519 in which a male terminal 517 is arranged. In the connector 511 of the second conventional example, then, the first housing portion 513 and the second housing portion 519 are fitted together so that the female terminal (not illustrated) and the male terminal 517 are connected together at a complete fitting position.

In the connector 511 of the second conventional example, moreover, the first housing portion 513 is rotatably provided on a body portion 523, the first housing portion 513 is provided with a guide rib portion 525, and the second housing portion 519 is provided with a guide rail surface 527 at a location before a position where the female terminal (not illustrated) and the male terminal 517 start contacting each other. The guide rail surface 527 guides the guide rib portion 525 so that the first housing portion 513 and the second housing portion 519 can be placed at a normal fitting rotation position.

SUMMARY

In the connector 511 of the second conventional example, the female terminal of the first housing portion 513 and the male terminal 517 of the second housing portion 519 are joined together under a condition where installation of the first housing portion 513 (or the body portion 523) in the second housing portion 519 is completed. However, a problem exists as given below; specifically, the joining of the second housing portion 519 and the first housing portion 513 (or the joining of the female terminal of the first housing portion 513 and the male terminal 517 of the second housing portion 519) may be released due to vibrations or the like.

An object of the disclosure is to provide a connector including a first connector constituent including a first terminal and a locking portion, and a second connector constituent including a second terminal and a locked portion, and configured so that the second terminal is joined to the first terminal when the second connector constituent is installed in the first connector constituent, in which under a condition where the second connector constituent is installed in the first connector constituent, the first connector constituent and the second connector constituent are not easily disjoined from each other thereby to enable ensuring the fitting of the first terminal to the second terminal.

A connector in accordance with some embodiments includes: a first connector constituent including a first terminal and a locking portion; a second connector constituent including a second terminal and a locked portion, and configured so that the second terminal is joined to the first terminal when the second connector constituent is installed in the first connector constituent; and a third connector constituent including a third terminal and a locked-portion holding portion configured to keep the locked portion locked to the locking portion when the third connector constituent is installed over the second connector constituent installed in the first connector constituent.

The first connector constituent may further include a first cylindrical portion inside of which the first terminal is provided, and the second connector constituent may further include a first cylindrical portion inside of which the second terminal is provided. In this case, an inside diameter of the first cylindrical portion of the first connector constituent is slightly larger than an outside diameter of the first cylindrical portion of the second connector constituent, and under a condition where the second connector constituent is installed in the first connector constituent, the first cylindrical portion of the second connector constituent enters the inside of the first cylindrical portion of the first connector constituent so that the first cylindrical portions are fitted to each other.

The second connector constituent may further include a second cylindrical portion having an outside diameter smaller than the inside diameter of the first cylindrical portion of the first connector constituent, the third connector constituent may further include a cylindrical portion having an outside diameter slightly smaller than the inside diameter of the first cylindrical portion of the first connector constituent, and having an inside diameter slightly larger than the outside diameter of the second cylindrical portion of the second connector constituent, the locking portion may be formed of any one of a recess portion and a through-hole provided in the first cylindrical portion of the first connector constituent, and the locked portion may include an elastic arm and a locked claw. In this case, the elastic arm is formed in a cantilever shape by providing a cutout to the second cylindrical portion of the second connector constituent, the elastic arm is bent inward under no external force applied, the locked claw is formed in such a way as to protrude and turn back from a distal end of the elastic arm outward of the second cylindrical portion of the second connector constituent, a portion formed by the turn-back is spaced away from the elastic arm at a predetermined distance therefrom, a portion of the cylindrical portion of the third connector constituent forms the locked-portion holding portion, and under a condition where the third connector constituent is installed over the second connector constituent installed in the first connector constituent, the cylindrical portion of the third connector constituent enters the inside of the first cylindrical portion of the first connector constituent, and the second cylindrical portion of the second connector constituent enters the inside of the cylindrical portion of the third connector constituent, and the locked-portion holding portion enters between the elastic arm and the portion formed by the turn-back of the locked claw to deform the elastic arm and to cause the portion formed by the turn-back of the locked claw to enter the locking portion, so that the locked portion is kept locked to the locking portion.

The first connector constituent may further include a second cylindrical portion, the second connector constituent may further include a second cylindrical portion having an inside diameter slightly larger than an outside diameter of the second cylindrical portion of the first connector constituent, the third connector constituent may further include a cylindrical portion having an inside diameter slightly larger than an outside diameter of the second cylindrical portion of the second connector constituent, the locking portion may be formed of any one of a recess portion and a through-hole provided in the second cylindrical portion of the first connector constituent, and the locked portion may further include an elastic arm. In this case, the elastic arm is formed in a cantilever shape by providing a cutout to the second cylindrical portion of the second connector constituent, a portion of the elastic arm slightly protrudes inward, a portion of the cylindrical portion of the third connector constituent forms the locked-portion holding portion, and under a condition where the second connector constituent is in process of being installed over the first connector constituent, the elastic arm is elastically deformed by being pressed by the second cylindrical portion of the first connector constituent, and after installation of the second connector constituent over the first connector constituent is completed, the elastic arm is restored to its original state, and the portion protruding inward of the elastic arm enters the locking portion, so that the locked portion is locked to the locking portion, and after installation of the third connector constituent over the second connector constituent installed over the first connector constituent is completed, the second cylindrical portion of the first connector constituent enters the inside of the second cylindrical portion of the second connector constituent, the second cylindrical portion of the second connector constituent enters the inside of the cylindrical portion of the third connector constituent, and the elastic arm enters the inside of the locked-portion holding portion, so that the locked portion is kept locked to the locking portion.

According to the configuration above, an advantageous effect is achieved as given below; specifically, it is possible to provide a connector including a first connector constituent including a first terminal and a locking portion, and a second connector constituent including a second terminal and a locked portion, and configured so that the second terminal is joined to the first terminal when the second connector constituent is installed in the first connector constituent, in which under a condition where the second connector constituent is installed in the first connector constituent, the connector constituents are not easily disjoined from each other thereby to enable ensuring the fitting together of connector portions.

DETAILED DESCRIPTION

Figure 1A:
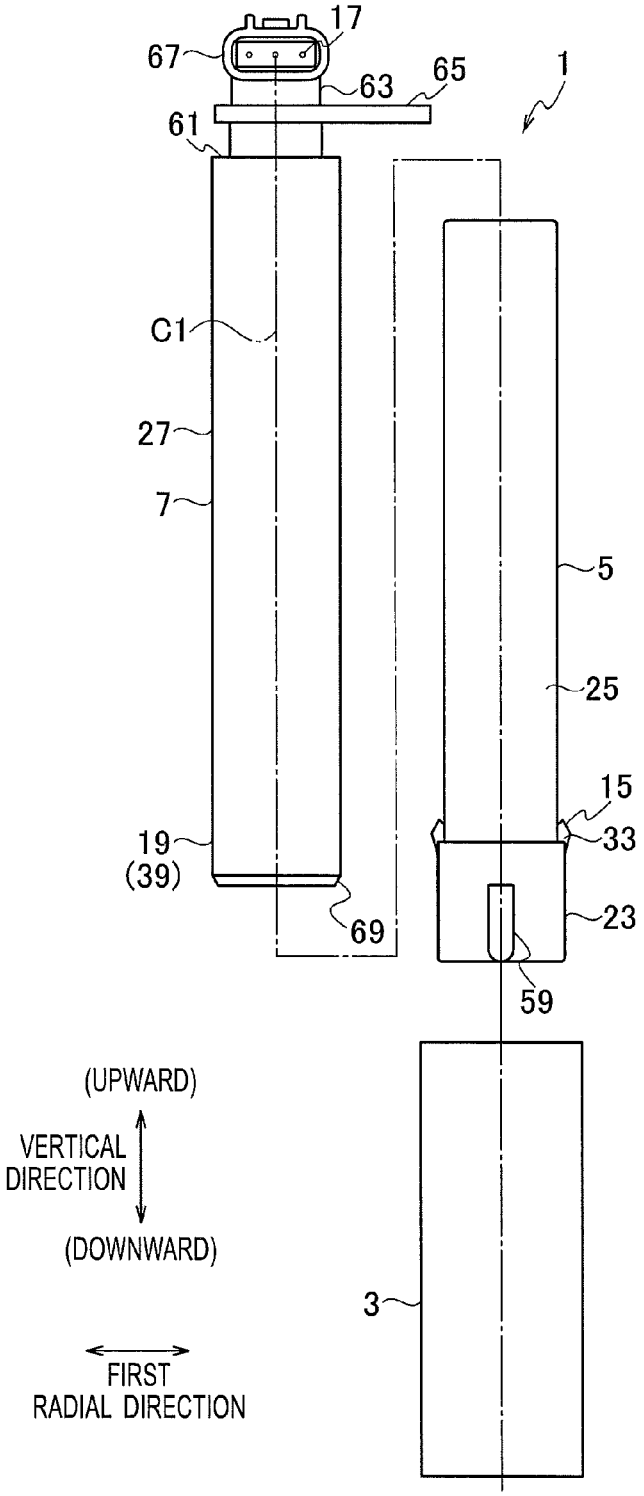
FIG. 1A is an exploded view of a connector according to a first embodiment.
Figure 1B:
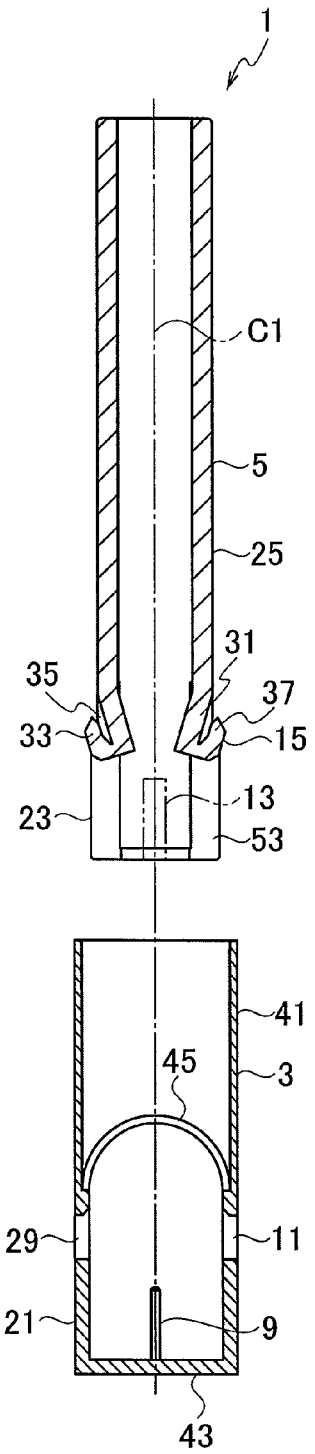
FIG. 1B is a cross-sectional view of structural components which form part of the connector according to the first embodiment.
Figure 2:
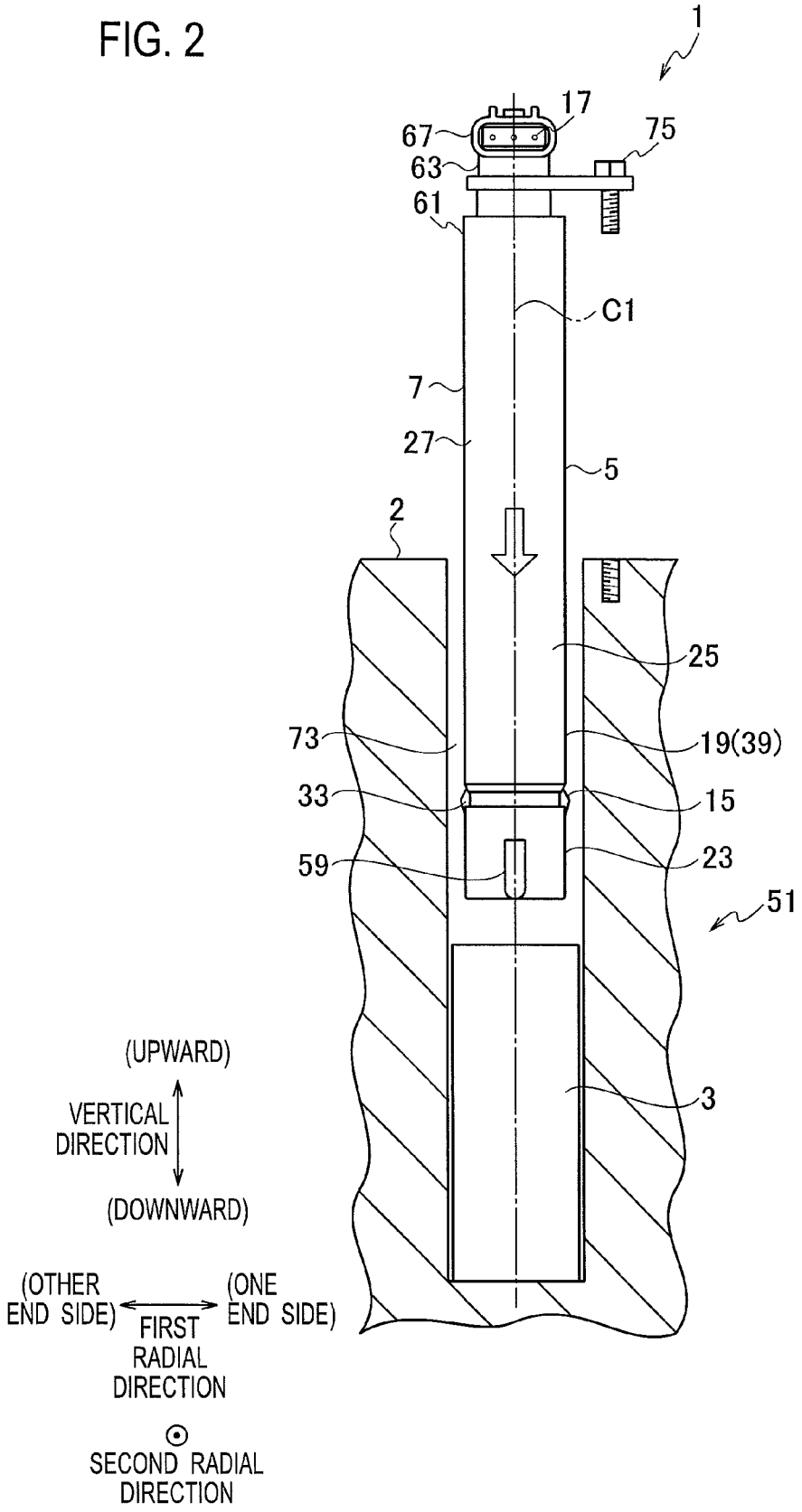
FIG. 2 is a view illustrating a state in which the connector according to the first embodiment is installed in a cylinder head, and is a view illustrating a state in which a first connector constituent is installed in the cylinder head and a second connector constituent and a third connector constituent are spaced away from the first connector constituent.

Embodiments of the present invention will be described in detail below by use of the drawings.

First Embodiment

A connector 1 according to a first embodiment will be described with reference to FIGS. 1 to 9.

For use, the connector 1 according to the first embodiment is integrally installed with a housing of equipment (for example, a cylinder head of an internal combustion engine such as a diesel engine), indicated by 2. The connector 1 includes a first connector constituent 3, a second connector constituent 5, and a third connector constituent 7.

The first connector constituent 3 is, for example, a receiving male connector, and includes a first terminal 9 and a locking portion 11. The first connector constituent 3 is integrally installed with the cylinder head 2.

The first connector constituent 3 is provided with an ignition device (not illustrated) such as a glow plug of the diesel engine. The first terminal 9 is formed of plural male terminals. The first terminal 9 is electrically connected to the ignition device.

Note that instead of or in addition to the provision of the ignition device in the first connector constituent 3, a sensor element such as a combustion pressure sensor element may be provided. Even when the sensor element is provided, the sensor element is electrically connected to the first terminal 9.

The second connector constituent 5 includes a second terminal 13 and a locked portion 15. The second terminal 13 of the second connector constituent 5 is joined to the first terminal 9, when the second connector constituent 5 is installed in the first connector constituent 3.

The second connector constituent 5 is a female connector (for example, a glow plug side female connector). The second terminal 13 is formed of plural female terminals.

The second connector constituent 5 is installed in the first connector constituent 3, and thereby, the male terminals of the first terminal 9 of the first connector constituent 3 are joined to the female terminals, respectively, of the second terminal 13 of the second connector constituent 5.

The third connector constituent 7 includes a third terminal 17 and a locked-portion holding portion 19. When the third connector constituent 7 is installed over the second connector constituent 5 installed in the first connector constituent 3 (or the preinstalled second connector constituent 5), the locked-portion holding portion 19 enters a space 38 at an elastic arm 31 thereby to restrain deformation in the elastic arm 31 and thus keep the locked portion 15 locked to the locking portion 11 (see FIG. 4).

The third connector constituent 7 is a wire harness side male connector, for example. The third terminal 17 is formed of plural male terminals.

The female terminals of the second terminal 13 are electrically connected to the male terminals, respectively, of the third terminal 17 by flexible wiring (not illustrated) (or electric wires extending through the insides of the second connector constituent 5 and the third connector constituent 7). Thus, the second connector constituent 5 and the third connector constituent 7 are linked together by the flexible wiring. The third connector constituent 7 is also adapted to be capable of changing its position or attitude with respect to the second connector constituent 5 to some degree of freedom (or within a range which the flexible wiring permits).

A wire harness (not illustrated) is connectable to the third terminal 17. When the third connector constituent 7 is installed over the preinstalled second connector constituent 5 and the wire harness is connected to the third terminal 17, the first terminal 9 is electrically connected to the wire harness via the second terminal 13, the flexible wiring and the third terminal 17.

Figure 4:
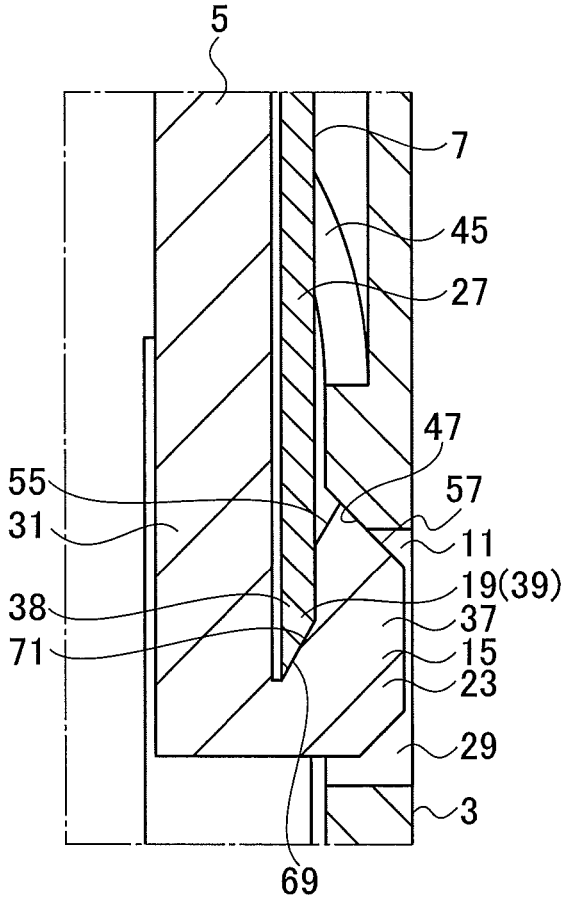
FIG. 4 is an enlarged view of a part IV of FIG. 3B.

As illustrated in FIG. 4, the third connector constituent is installed over the preinstalled second connector constituent 5, and thereby, the locked portion 15 is locked to the locking portion 11.

Figure 8:
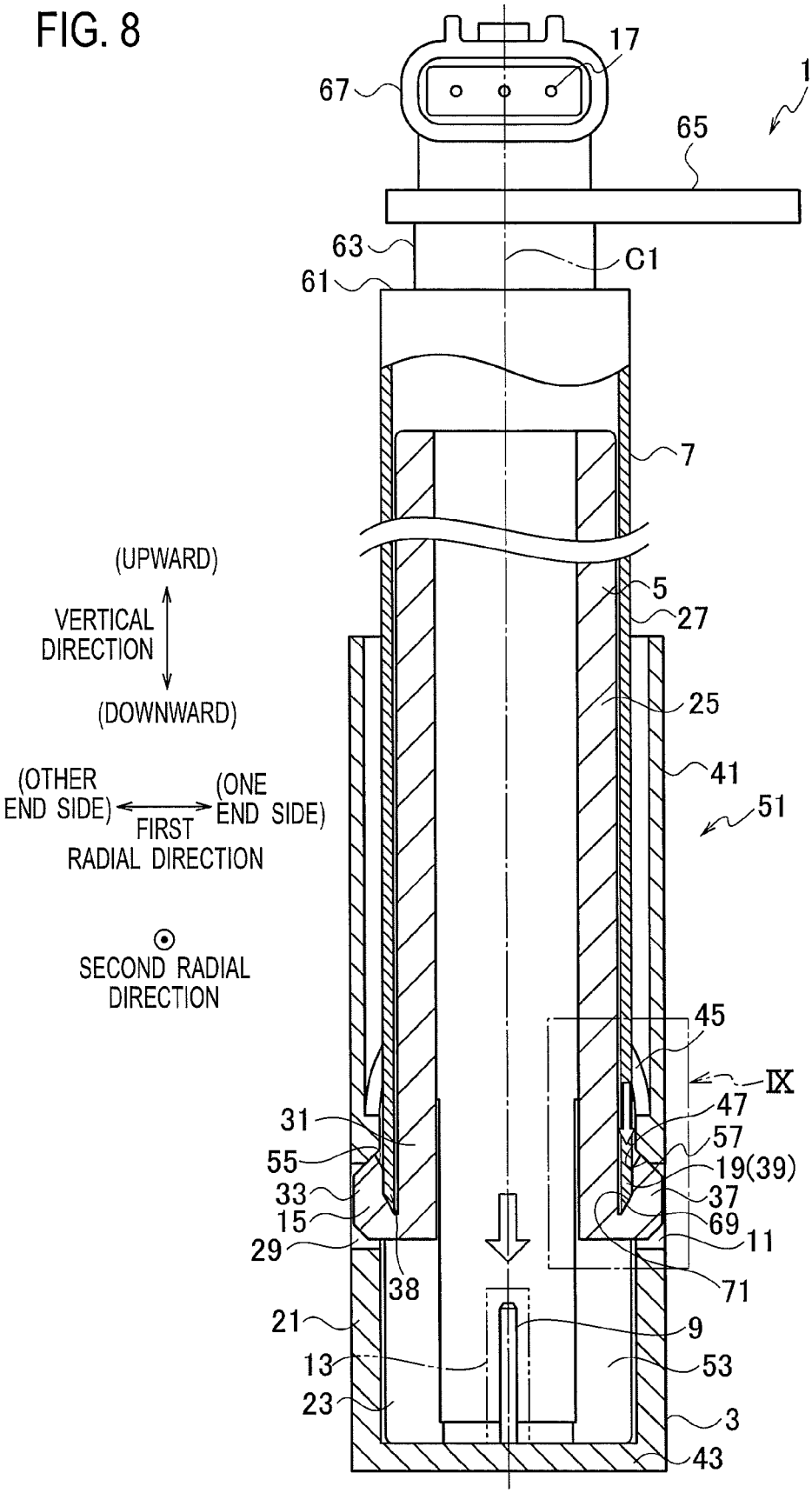
FIG. 8 is a view illustrating a state of completion of installation of the second connector constituent and the third connector constituent in the first connector constituent of the connector according to the first embodiment.

The locked portion 15 is maintained in its state locked to the locking portion 11 unless the third connector constituent 7 installed over the preinstalled second connector constituent (or the preinstalled third connector constituent 7) is separated from the preinstalled second connector constituent 5. In other words, the locked-portion holding portion 19 engages the locked portion 15, and thereby, the locked portion 15 is kept locked to the locking portion 11. It is necessary to disengage the locked-portion holding portion 19 from the locked portion 15, in order to release such holding by the locked-portion holding portion 19 (or move the third connector constituent 7 upward as seen in FIG. 8) thereby to move the preinstalled second connector constituent 5 upward from its FIG. 8 position and in turn remove the second connector constituent 5 from the first connector constituent 3.

Figure 6:
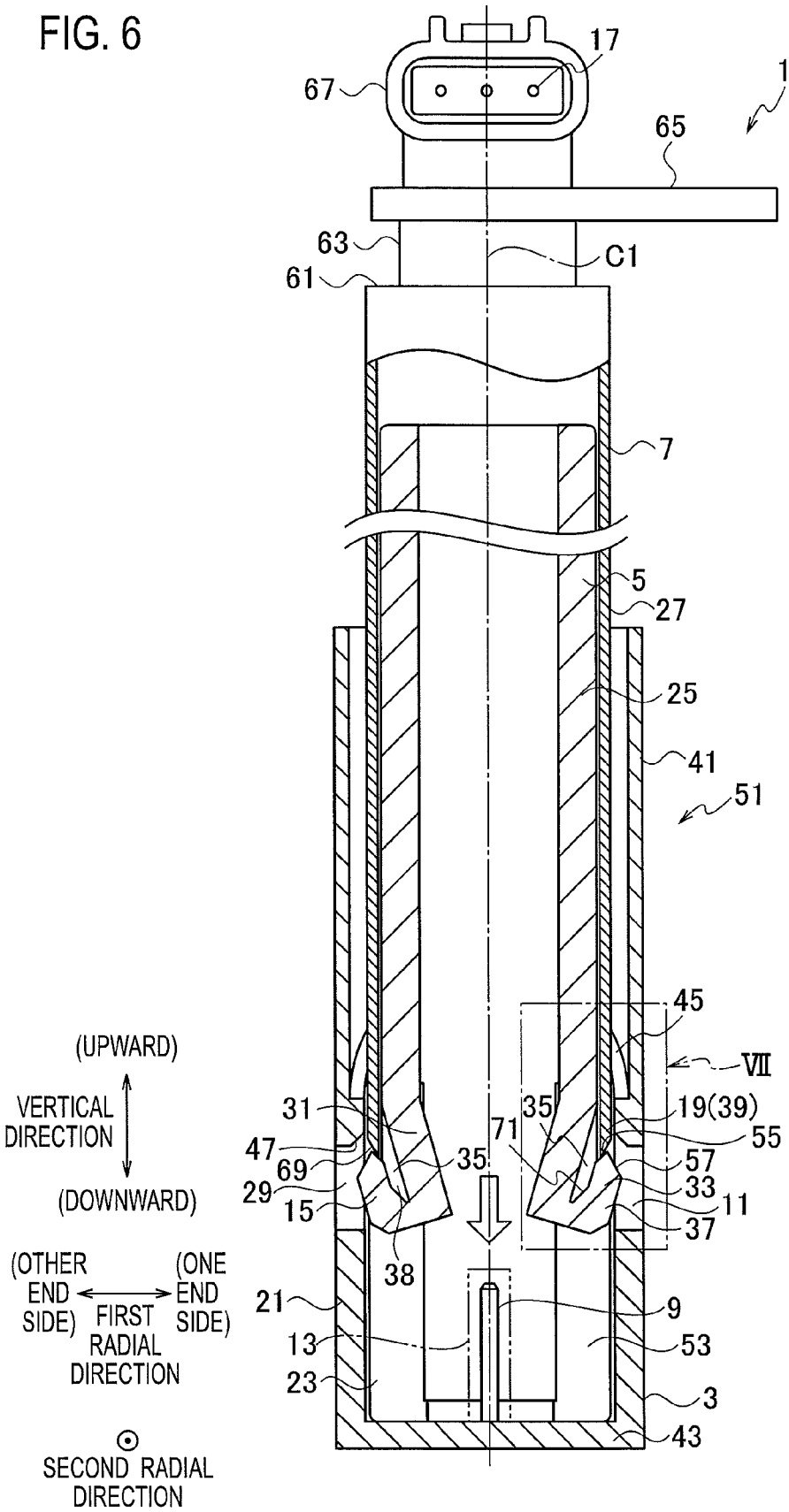
FIG. 6 is a view illustrating a state in which the second connector constituent and the third connector constituent are in process of being installed in the first connector constituent of the connector according to the first embodiment.
Figure 7:
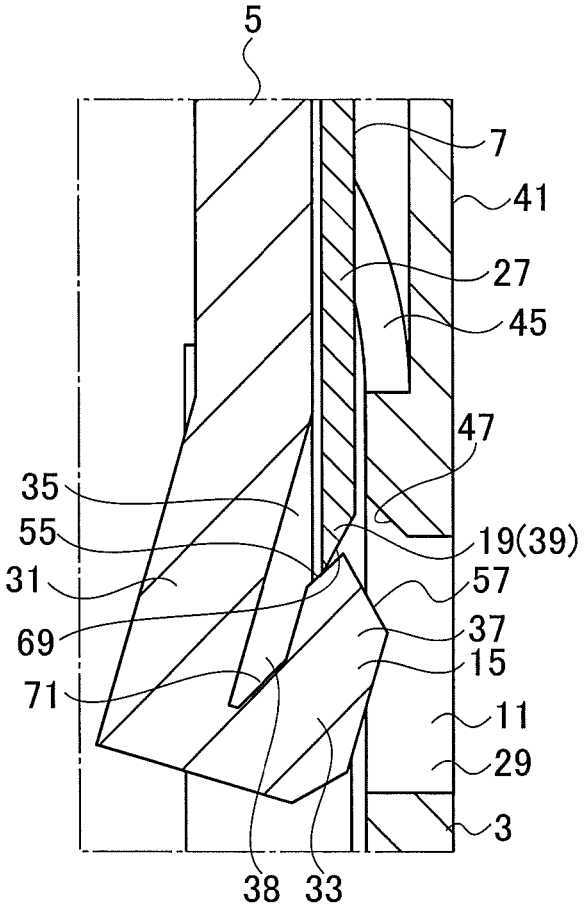
FIG. 7 is an enlarged view of a part VII of FIG. 6.

In the connector 1, as illustrated in FIG. 6, the locked portion 15 is not locked to the locking portion 11 under a condition where the second connector constituent 5 is merely installed in the first connector constituent 3 (or in a state of the preinstalled second connector constituent 5). As illustrated in FIG. 8, the third connector constituent 7 is installed over the preinstalled second connector constituent 5, and thereby, the locked-portion holding portion 19 engages the locked portion 15 so that the locked portion 15 becomes deformed, and then the deformed locked portion 15 is engaged with the locking portion 11 and is thus locked to the locking portion 11. Then, so long as the locked-portion holding portion 19 engages the locked portion 15, the locked portion 15 remains in its state engaged with the locking portion 11 without becoming deformed (or is not restored to its state before the installation of the third connector constituent 7), so that the locked portion 15 is maintained (or held) in its state engaged with and locked to the locking portion 11.

The first connector constituent 3 includes a first cylindrical portion 21 provided on its inside with the first terminal 9. The second connector constituent 5 includes a first cylindrical portion 23 provided on its inside with the second terminal 13.

An inside diameter of the first cylindrical portion 21 of the first connector constituent 3 is slightly larger than an outside diameter of the first cylindrical portion 23 of the second connector constituent 5. Under a condition where the second connector constituent 5 is installed in the first connector constituent 3, as illustrated in FIGS. 6 and 8, the first cylindrical portion 23 of the second connector constituent 5 enters the inside of the first cylindrical portion 21 of the first connector constituent 3 so that the first cylindrical portions 23, 21 are fitted to each other.

The second connector constituent 5 includes a second cylindrical portion 25 having an outside diameter smaller than the inside diameter of the first cylindrical portion 21 of the first connector constituent 3. The third connector constituent 7 includes a cylindrical portion 27. An outside diameter of the cylindrical portion 27 is slightly smaller than the inside diameter of the first cylindrical portion 21 of the first connector constituent 3. An inside diameter of the cylindrical portion 27 of the third connector constituent 7 is slightly larger than the outside diameter of the second cylindrical portion 25 of the second connector constituent 5.

The locking portion 11 is formed of a through-hole 29 provided in the first cylindrical portion 21 of the first connector constituent 3. Note that the locking portion 11 may be formed of a recess portion instead of or in addition to being formed of the through-hole 29. In other words, the locking portion 11 may be formed of either the through-hole or the recess portion provided in the first cylindrical portion 21 of the first connector constituent 3.

The locked portion 15 includes the elastic arm 31 and a locked claw 33.

The elastic arm 31 is formed in a cantilever shape by providing at least a pair of cutouts 35 in the second cylindrical portion 25 of the second connector constituent 5. The pair of cutouts 35 are formed in such a manner that the cutouts 35 extend long in a direction of extension of a central axis C1 of the second cylindrical portion 25 of the second connector constituent 5, are spaced apart with a slight gap in between in a peripheral direction of the second cylindrical portion 25 of the second connector constituent 5, and extend through a heavy portion of the second cylindrical portion 25 of the second connector constituent 5. The pair of cutouts 35 are provided thereby to form the one elastic arm 31.

Figure 5:
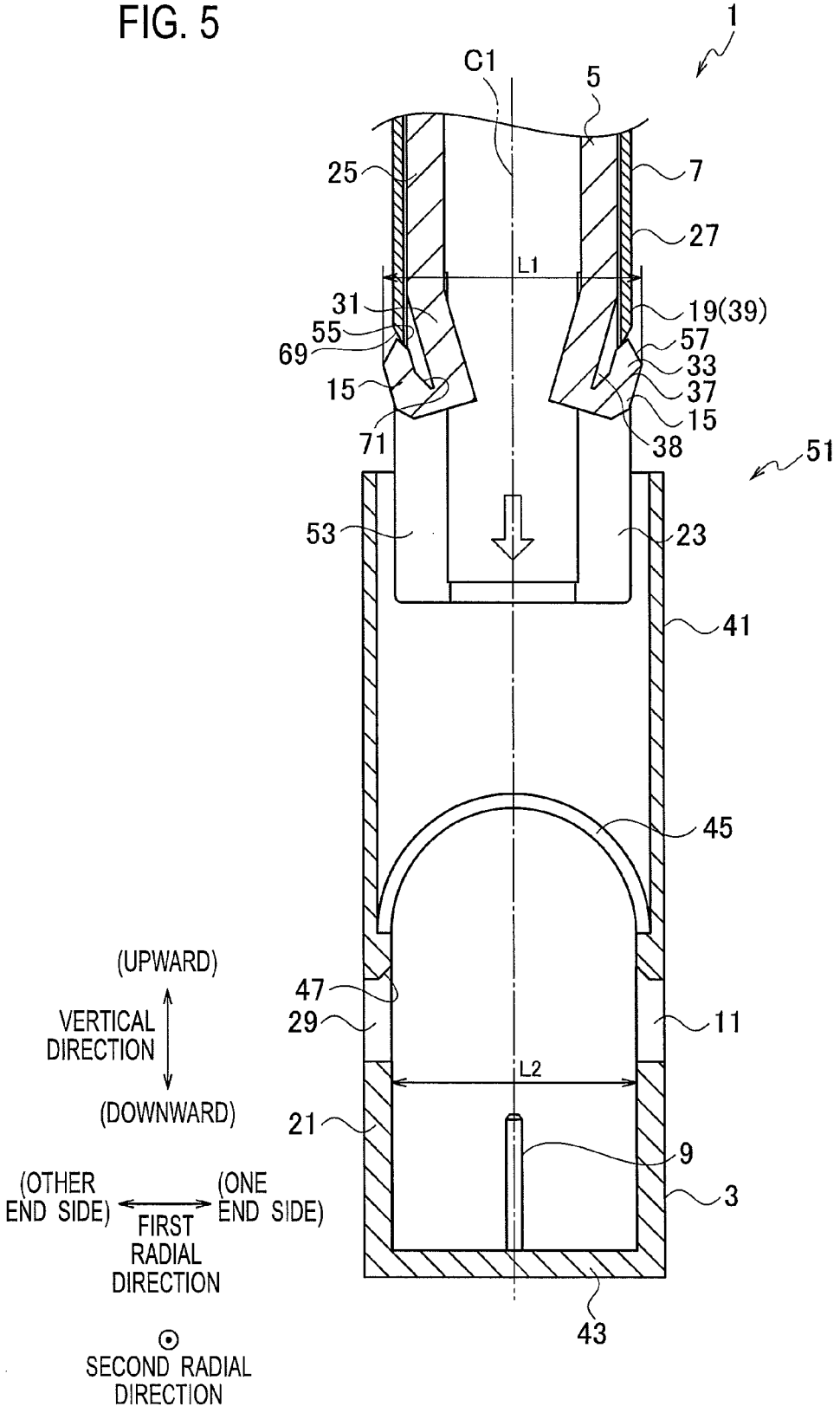
FIG. 5 is a view illustrating a state in which the second connector constituent and the third connector constituent are in process of being installed in the first connector constituent of the connector according to the first embodiment.

The elastic arm 31, under no external force applied (i.e. under normal conditions or in its non-engaged state), is bent inward as illustrated in FIG. 5. In other words, the elastic arm 31 is bent in such a way as to be located closer to the central axis C1 of the second cylindrical portion 25 of the second connector constituent 5 as the elastic arm 31 extends from its proximal end (or upper end) toward its distal end (or lower end).

The locked claw 33 is formed in such a way as to protrude and turn back from the distal end of the elastic arm 31 outward of the second cylindrical portion 25 of the second connector constituent 5, as illustrated in FIGS. 6 to 9. A portion 37 formed by such turn-back is spaced away from the elastic arm 31 at a predetermined distance 38 therefrom (or with a gap 38 in between, the gap 38 having a value equal to or slightly larger than a value of a thickness of a heavy portion of the cylindrical portion 27 of the third connector constituent 7).

The elastic arm 31 is bent inward, so that under no external force applied, a value of a distance between the outermost end of the locked claw 33 and the central axis C1 of the second cylindrical portion 25 of the second connector constituent 5 is substantially equal to ½ of a value of the inside diameter of the first cylindrical portion 21 of the first connector constituent 3.

For example, as illustrated in FIG. 5, if the two locked portions 15 (or elastic arms 31 and locked claws 33) are symmetrically disposed with respect to the central axis C1 of the second cylindrical portion 25 of the second connector constituent 5, under no external force applied, a distance L1 between the outermost ends of a pair of the locked claws 33 is, for example, substantially equal to an inside diameter L2 of the first cylindrical portion 21 of the first connector constituent 3.

Also, a portion (for example, a tip portion) 39 of the cylindrical portion 27 of the third connector constituent 7 forms the locked-portion holding portion 19.

Under a condition where the third connector constituent 7 is installed over the second connector constituent 5 installed in the first connector constituent 3 (or at the completion of installation), the central axes C1 of all the cylindrical portions 21, 23, 25, 27 coincide with one another as illustrated in FIG. 8. Then, the cylindrical portion 27 (or the lower end portion 39) of the third connector constituent 7 enters the inside of the first cylindrical portion 21 of the first connector constituent 3, and the second cylindrical portion 25 of the second connector constituent 5 enters the inside of the cylindrical portion 27 of the third connector constituent 7, so that the locked-portion holding portion 19 enters the space (or gap) 38 formed between the elastic arm 31 and the portion 37 formed by the turn-back of the locked claw 33.

Thus, a configuration is such that the elastic arm 31 is deformed (or is, for example, elastically deformed outward) and extends in the direction of extension of the central axis C1 in the same manner as the second cylindrical portion 25 of the second connector constituent 5, and the portion 37 formed by the turn-back of the locked claw 33 enters the locking portion 11, so that the locked portion 15 is kept locked to the locking portion 11.

The connector 1 will now be described in further detail. For convenience of explanation, the direction of extension of the central axes C1 of the cylindrical portions 21, 23, 25, 27 is referred to as a vertical direction, one predetermined direction orthogonal to the vertical direction is referred to as a first radial direction, and another predetermined direction orthogonal to the vertical direction and the first radial direction is referred to as a second radial direction.

The first connector constituent 3 is integrally installed with the cylinder head 2 by an external thread portion (not illustrated), as is the case with the connector of the second conventional example disclosed in Japanese Patent Application No. 2012-280784. Under a condition where the first connector constituent 3 is installed in the cylinder head 2, therefore, an angle of rotation of the first connector constituent 3 around the central axis C1 does not remain constant but changes due to a difference between the individual first connector constituents 3 or cylinder heads 2, or the like. For example, when the two first connector constituents 3 are installed in the two cylinder heads 2, respectively, the angle of rotation of one of the first connector constituents 3 around the central axis C1 may possibly coincide with, but is often different from, the angle of rotation of the other of the first connector constituents 3 around the central axis C1.

Figure 3A:
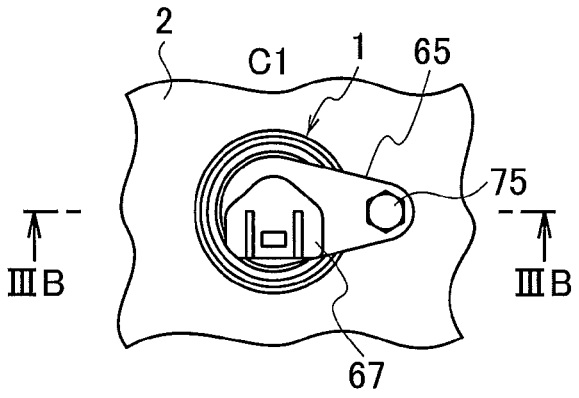
FIG. 3A is a view illustrating a state in which the connector according to the first embodiment is installed in the cylinder head.
Figure 3B:
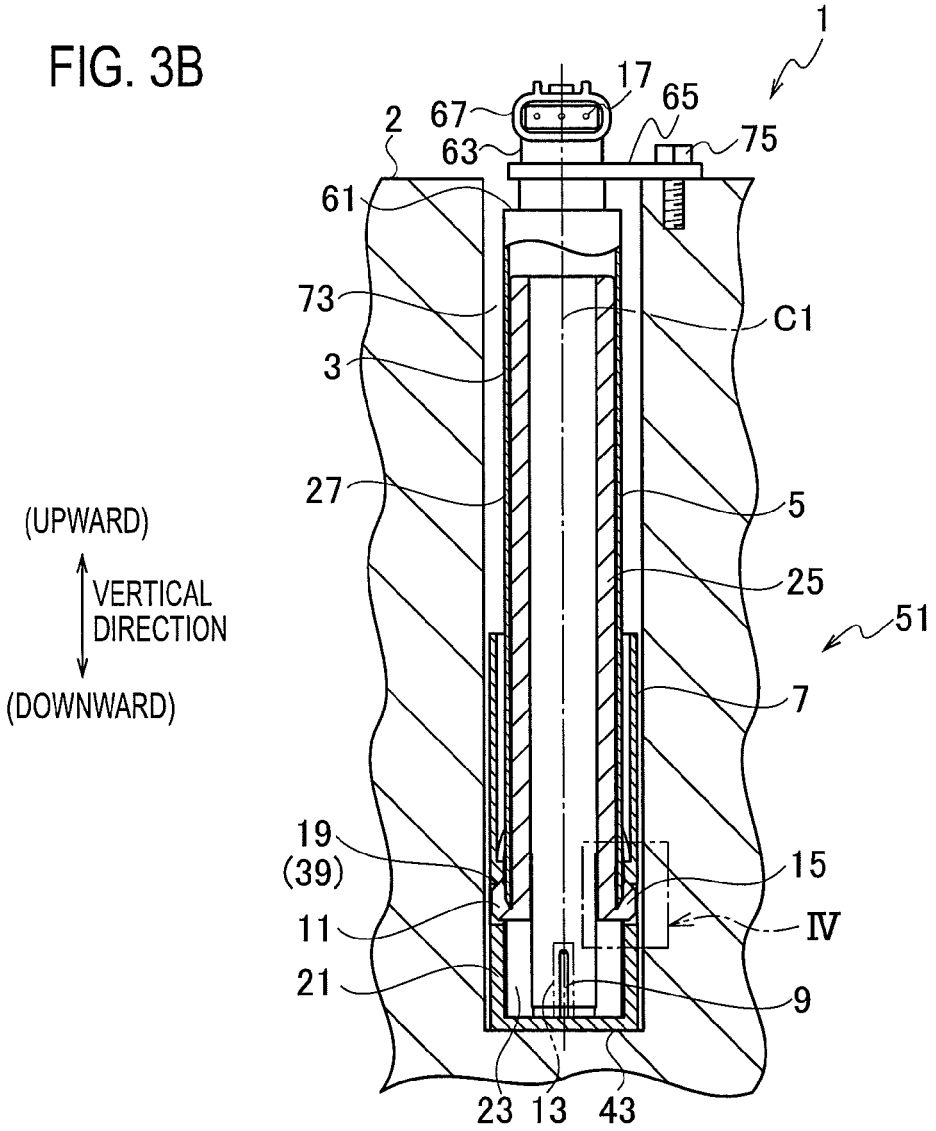
FIG. 3B is a cross-sectional view taken along line IIIB-IIIB of FIG. 3A, and is a view illustrating a state in which the first connector constituent is installed in the cylinder head and the second connector constituent and the third connector constituent are installed in the first connector constituent.

Meanwhile, the third connector constituent 7 needs to keep constant an angle of rotation thereof around the central axis C1 in order to keep constant a position of rotation of the third terminal 17 to which the wire harness is connected (or the terminal 17 protruding in a direction orthogonal to the central axis C1) (see FIG. 3).

Moreover, a plurality of the first terminals 9 of the first connector constituent 3 and a plurality of the second terminals 13 of the second connector constituent 5 are provided, and thus, the installation of the second connector constituent 5 in the first connector constituent 3 installed in the cylinder head 2 requires that the second connector constituent 5 be rotated (or rotationally moved) as appropriate around the central axis C1 so that the male terminals of the first terminals 9 of the first connector constituent 3 are joined to the female terminals, respectively, of the second terminals 13 of the second connector constituent 5.

For such a need, the second connector constituent 5 is adapted to be rotatable relative to the third connector constituent 7, around the central axis C1, within a predetermined range of angles (for example, a range of plus or minus 180°). There is also provided a rotational positioning portion 51 configured to engage the second connector constituent 5 in the first connector constituent 3 and effect rotational positioning of the second connector constituent 5, at the time of installation of the second connector constituent 5 and the third connector constituent 7 in the first connector constituent 3 installed in the cylinder head 2. As is the case with the connector of the second conventional example disclosed in Japanese Patent Application No. 2012-280784, the rotational positioning portion 51 guides the second connector constituent 5 to the first connector constituent 3 so that the second connector constituent 5 is located at a normal position of fitting relative to the first connector constituent 3.

The first connector constituent 3 includes the first cylindrical portion 21, a second cylindrical portion 41, and a bottom wall portion 43. An outside diameter of the second cylindrical portion 41 is equal to an outside diameter of the first cylindrical portion 21. An inside diameter of the second cylindrical portion 41 is slightly larger than the inside diameter of the first cylindrical portion 21. The central axis C1 of the second cylindrical portion 41 coincides with the central axis C1 of the first cylindrical portion 21, and the second cylindrical portion 41 is connected to the first cylindrical portion 21 on its upper side.

A guide rail surface (or a rotation direction guide portion) 45 is formed on an upper end of the first cylindrical portion 21 of the first connector constituent 3, as is the case with the connector of the second conventional example disclosed in Japanese Patent Application No. 2012-280784. The guide rail surface 45 has the shape of a cut surface of the upper side of a cylindrical material which forms the first cylindrical portion 21, as cut along a plane obliquely intersecting the central axis C1.

The guide rail surface 45 is lowest in level at one end in the second radial direction (or forward of the sheet as seen in FIG. 8) and is highest in level at the other end in the second radial direction (or backward of the sheet as seen in FIG. 8).

The bottom wall portion 43 closes a lower end of the first cylindrical portion 21 of the first connector constituent 3. The inside of the first cylindrical portion 21 of the first connector constituent 3 forms a terminal fitting chamber, and the first terminal 9 protrudes upward from the bottom wall portion 43.

The external thread portion (not illustrated) is formed on an underside of the bottom wall portion 43 in order to install the first connector constituent 3 in the cylinder head 2, and the ignition device such as the glow plug is disposed within the external thread portion.

A pair of the through-holes 29, for example, are provided to form the locking portions 11. The pair of through-holes 29 are symmetrically arranged with respect to the central axis C1, on the upper side of the first cylindrical portion 21 of the first connector constituent 3. The pair of through-holes 29 are arranged on one end side and the other end side, respectively, in the first radial direction.

The through-hole 29 is formed in a rectangular shape, for example. A chamfered surface 47 engageable with the locked portion 15 is formed in the through-hole 29. The chamfered surface 47 is formed on the inside of the first cylindrical portion 21 of the first connector constituent 3 and also on an upper side of the through-hole 29.

The first cylindrical portion 21 of the first connector constituent 3 is provided with a guide groove 49 (not illustrated in FIGS. 1 to 21; see FIG. 22), as is the case with the connector of the second conventional example disclosed in Japanese Patent Application No. 2012-280784. The guide groove 49 is disposed at a location where the guide rail surface 45 is lowest in level at one end in the second radial direction (or forward of the sheet as seen in FIG. 8).

The guide groove 49 has a predetermined width in the first radial direction and extends from the guide rail surface 45 to the bottom wall portion 43. In the second radial direction, the guide groove 49 is also formed having a predetermined depth outward from an inner surface of the first cylindrical portion 21 of the first connector constituent 3.

The second connector constituent 5 includes the first cylindrical portion 23 and the second cylindrical portion 25. The outside diameter of the first cylindrical portion 23 is slightly smaller than the inside diameter of the first cylindrical portion 21 of the first connector constituent 3. The outside diameter of the second cylindrical portion 25 is smaller than the outside diameter of the first cylindrical portion 23. The central axis C1 of the first cylindrical portion 23 coincides with the central axis C1 of the second cylindrical portion 25, and the second cylindrical portion 25 is connected to the first cylindrical portion 23 on its upper side.

A height dimension of the first cylindrical portion 23 of the second connector constituent 5 is slightly smaller than a height dimension of the first cylindrical portion 21 of the first connector constituent 3. A height dimension of the second connector constituent 5 is larger than a height dimension of the first connector constituent 3.

The second terminal 13 is disposed within the first cylindrical portion 23 of the second connector constituent 5 and also on a lower end of the first cylindrical portion 23.

The elastic arm 31 and the locked claw 33 which form the locked portion 15 are formed between the two cutouts 35 in proximity to each other, formed in the second cylindrical portion 25 of the second connector constituent 5. The cutouts 35 which form the cantilever-shaped elastic arm 31 extend by a predetermined length upward from a lower end of the second cylindrical portion 25 of the second connector constituent 5. Thus, the cantilever-shaped elastic arm 31 is disposed in such a manner that its distal end is located downward and its proximal end is located upward. The locked claw 33 is formed on the distal end of the elastic arm 31.

The elastic arm 31 and the locked claw 33 are provided as a pair and are arranged on both ends in the first radial direction. A cutout 53 having a width dimension having the same value as a value of an outside dimension between the two cutouts 35 is provided under the elastic arm 31, the locked claw 33 and the two cutouts 35 (or in a portion of the first cylindrical portion 23 of the second connector constituent 5).

The locked claw 33 includes the turn-back portion 37. Upon completion of installation of the third connector constituent 7 over the preinstalled second connector constituent 5, the turn-back portion 37 enters the through-hole 29 of the first connector constituent 3, so that the locked portion 15 is locked to the locking portion 11.

The turn-back portion 37 is provided with a first guide surface (or a chamfered surface) 55. The first guide surface 55 is provided on the inside (or on the central axis C1 side) of a tip end (or an upper end) of the locked claw 33. The first guide surface 55 is provided thereby to guide the tip portion (or the lower end portion) 39 (or the locked-portion holding portion 19) of the cylindrical portion 27 of the third connector constituent 7 and thus allow the locked-portion holding portion 19 to easily enter the space 38, at the time of installation of the third connector constituent 7 over the preinstalled second connector constituent 5.

The turn-back portion 37 is provided with a second guide surface (or a chamfered surface) 57. The second guide surface 57 is provided on the outside (or on the opposite side from the central axis C1) of the tip end (or the upper end) of the locked claw 33. Upon completion of installation of the third connector constituent 7 over the preinstalled second connector constituent 5, the second guide surface 57 makes a surface contact with the chamfered surface 47 of the through-hole 29. Thus, the second connector constituent 5 is installed in the first connector constituent 3 without rattling.

The second connector constituent 5 is provided with a guide rib 59 (not illustrated in FIGS. 3 to 21; see FIGS. 1, 2, 22), as is the case with the connector of the second conventional example disclosed in Japanese Patent Application No. 2012-280784. The guide rib 59 is provided in a manner protruding on one end side in the second radial direction (or forward of the sheet as seen in FIG. 8), on the lower end side of an outer periphery of the first cylindrical portion 23 of the second connector constituent 5. A lower end surface of the guide rib 59 is formed throughout its entire area, as a semicircular arcuate surface. The arcuate surface is lowest in level at its center and gradually rises upward on its left and right sides.

When the second connector constituent 5 is moved downward and thereby brought close to the first connector constituent 3 in order to install the second connector constituent 5 in the first connector constituent 3 installed in the cylinder head 2, a lower end of the guide rib 59 first abuts the guide rail surface 45. When the second connector constituent 5 is further moved downward, the guide rib 59 which forms the rotational positioning portion 51 slides relative to the guide rail surface 45 so that the second connector constituent 5 rotates about the central axis C1, and thus the guide rib 59 enters an upper end of the guide groove 49 thereby to effect rotational positioning of the second connector constituent 5 relative to the first connector constituent 3.

When the second connector constituent 5 is further moved downward, the plural first terminals 9 of the first connector constituent 3 are joined to the plural second terminals 13, respectively, of the second connector constituent 5.

When the guide rib 59 abuts the guide rail surface 45, the guide rail surface 45 guides the guide rib 59 so that the second connector constituent 5 reaches a normal position of rotational fitting relative to the first connector constituent 3, before the first terminals 9 and the second terminals 13 reach a fitting position at which the terminals 9, 13 start contacting each other. The guide groove 49 restrains rotation of the guide rib 59 (or the second connector constituent 5) and permits only movement thereof such that the second connector constituent 5 is fitted in the first connector constituent 3 at a normal position of fitting rotation. The guide rib 59 enters the guide groove 49, and thereafter, the male terminals of the first terminals 9 of the first connector constituent 3 start contacting the female terminals, respectively, of the second terminals 13 of the second connector constituent 5. Then, the first terminals 9 are in proper contact with the second terminals 13 at a complete fitting position at which the guide rib 59 enters the guide groove 49 in its innermost portion (or on its lower side).

The third connector constituent 7 includes the cylindrical portion 27, a bottom wall portion 61, a body portion 63, a mounting arm portion 65, and a terminal placement portion 67.

The outside diameter of the cylindrical portion 27 of the third connector constituent 7 is slightly smaller than the inside diameter of the first cylindrical portion 21 of the first connector constituent 3. The inside diameter of the cylindrical portion 27 of the third connector constituent 7 is slightly larger than the outside diameter of the second cylindrical portion 25 of the second connector constituent 5.

A height dimension of the cylindrical portion 27 of the third connector constituent 7 is larger than the height dimension of the second connector constituent 5. A lower end of the cylindrical portion 27 of the third connector constituent 7 is provided with a chamfered surface 69. The chamfered surface 69 is provided on the outside of the cylindrical portion 27. At the time of installation of the third connector constituent 7 over the preinstalled second connector constituent 5, the chamfered surface 69 engages the chamfered surface 55 of the locked portion 15 of the second connector constituent 5 thereby to guide the third connector constituent 7. Thus, this facilitates entry of the locked-portion holding portion 19 formed on the lower end of the cylindrical portion 27 of the third connector constituent 7, into the space 38 between the elastic arm 31 and the portion 37 of the locked claw 33.

At the completion of installation of the third connector constituent 7 over the preinstalled second connector constituent 5, the chamfered surface 69 is in surface contact with a chamfered surface 71 provided on a proximal end of the locked claw 33.

The bottom wall portion 61 closes an upper end of the cylindrical portion 27 of the third connector constituent 7. The body portion 63 is arranged on the bottom wall portion 61 on its upper side. The mounting arm portion 65 is provided in a manner protruding from the body portion 63 toward one end in the first radial direction. The terminal placement portion 67 is arranged on the body portion 63 on its upper side. The third terminal 17 is provided within the terminal placement portion 67. The terminal placement portion 67 is open at one end side in the second radial direction so that the wire harness installed in the terminal placement portion 67 (or the third terminal 17) extends out toward one end in the second radial direction.

The cylinder head 2 is provided with a recess portion 73 opening upward. The connector 1 installed in the cylinder head 2 is configured in such a manner that its portion above the mounting arm portion 65, inclusive of the mounting arm portion 65, protrudes upward from the recess portion 73, and its portion below the mounting arm portion 65 is present in the recess portion 73.

A bottom surface of the recess portion 73 of the cylinder head 2 is provided with internal threads (not illustrated) into which external threads (not illustrated) of the first connector constituent 3 are screwed.

In the connector 1 installed in the cylinder head 2, the mounting arm portion 65 is in contact with a peripheral portion of the recess portion 73 of the cylinder head 2, and the mounting arm portion 65 (or the third connector constituent 7) is fixed to the cylinder head 2 by a fastening member 75 such as a mounting screw (or a bolt) (see FIG. 3).

Under a condition before the installation of the second connector constituent 5 in the first connector constituent 3 installed in the cylinder head 2, the second connector constituent 5 and the third connector constituent 7 are linked together via the electric wire (not illustrated).

As further described, the second connector constituent 5 is configured so that the second cylindrical portion 25 is located on an upper side of the second connector constituent 5 and the first cylindrical portion 23 is located on a lower side thereof. Then, the cylindrical portion 27 of the third connector constituent 7 is open at the lower side, and the second cylindrical portion 25 of the second connector constituent 5 enters the cylindrical portion 27 of the third connector constituent 7. Also, the chamfered surface 55 of the locked portion of the second connector constituent 5 is in contact with the chamfered surface 69 of the third connector constituent 7.

The electric wire (not illustrated) extends through the inside of the cylindrical portion 27 of the third connector constituent 7 and the inside of the second cylindrical portion 25 of the second connector constituent 5 and connects the second terminal 13 and the third terminal 17 together.

The second connector constituent 5 and the third connector constituent 7 are also provided with a rotation restraining portion (not illustrated), as is the case with the connector of the second conventional example disclosed in Japanese Patent Application No. 2012-280784. Thus, the amount of rotation of the second connector constituent 5 relative to the third connector constituent 7 around the central axis C1 is limited for example within a range of plus or minus 180°, thereby preventing the electric wire (not illustrated) from becoming excessively twisted.

In the above description, the elastic arm 31 is bent inward under no external force applied; when the third connector constituent 7 is installed over the second connector constituent 5 installed in the first connector constituent 3, the elastic arm 31 is elastically deformed, and thus, the locked claw 33 enters the through-hole 29 so that the locked portion 15 is locked to the locking portion 11. However, such a configuration is not necessarily required.

For example, a configuration may be such that the elastic arm is not bent inward under no external force applied, and the elastic arm is elastically deformed inward under a condition where a second connector is in process of being installed in a first connector, and then, upon completion of installation of the second connector in the first connector, the elastic arm is restored to its original state, and the locked claw enters the locking portion so that the locked portion is locked to the locking portion.

Next, description will be given with regard to an assembly operation for installation of the second connector constituent 5 and the third connector constituent 7 in the first connector constituent 3 installed in the cylinder head 2.

An initial state is set so that the second connector constituent 5 (or the third connector constituent 7) is located apart from and above the first connector constituent 3, as illustrated in FIG. 5. The initial state is also set so that the central axes C1 of the connector constituents 3, 5, 7 coincide with one another. The initial state is also set so that the chamfered surface 55 of the second connector constituent 5 presses against the chamfered surface 69 of the third connector constituent 7 by a small force so that the second connector constituent 5 and the third connector constituent 7 are integral with each other under a small holding force.

In such an initial state, the second connector constituent 5 (or the third connector constituent 7) is moved downward. Except when the second connector constituent 5 is inserted into the first connector constituent 3 at the normal position of fitting rotation, the guide rib 59 of the second connector constituent 5 abuts the guide rail surface 45 of the first connector constituent 3 at any given location. Then, the guide rib 59 slides along the guide rail surface 45 so that the second connector constituent 5 appropriately rotates relative to the first connector constituent 3, about the central axis C1. In this manner, the second connector constituent 5 reaches a position of rotation at which the guide rib 59 is located at the lowermost position of the guide rail surface 45. Thus, the second connector constituent 5 and the first connector constituent 3 reach the normal position of fitting rotation.

Then, when the second connector constituent 5 is further moved downward to go on with its fitting, the guide rib 59 starts entering the guide groove 49. Here, joining together of the first terminal 9 and the second terminal 13, engagement between the locked-portion holding portion 19 and the locked portion 15, and engagement between the locking portion 11 and the locked portion 15 start.

Downward movement of the second connector constituent 5 is performed until a lower end of the second connector constituent 5 abuts the bottom wall portion 43 of the first connector constituent 3, as illustrated in FIG. 6. Here, the guide rib 59 enters the guide groove 49, and the second connector constituent 5 does not rotate around the central axis C1 but merely moves downward. The lower end of the second connector constituent 5 abuts the bottom wall portion 43 of the first connector constituent 3 thereby to finish the installation of the second connector constituent 5 in the first connector constituent 3.

Note that when the second connector constituent 5 starts fitting in the first connector constituent 3 at the normal position of fitting rotation, the guide rib 59 does not slide along the guide rail surface 45 but directly enters the guide groove 49.

Then, when the third connector constituent 7 is appropriately rotationally positioned relative to the second connector constituent 5 in order to adjust the orientation of the third terminal 17 and the third connector constituent 7 is moved downward, the locked-portion holding portion 19 (or the lower end portion of the cylindrical portion 27 of the third connector constituent 7) enters the space 38 between the elastic arm 31 and the turn-back portion 37 of the locked claw 33, as illustrated in FIG. 8. Then, a pair of the elastic arms 31 are deformed outward, and the turn-back portion 37 of the locked claw 33 enters the through-hole 29 of the first connector constituent 3, so that the locked portion 15 of the second connector constituent 5 is locked to the locking portion 11 of the first connector constituent 3.

Thus, the third connector constituent 7 is installed over the preinstalled second connector constituent 5, so that the cylinder head 2, the first connector constituent 3, the second connector constituent 5 and the third connector constituent 7 become integral with one another. Also, the mounting arm portion 65 of the third connector constituent 7 contacts the cylinder head 2.

Then, the third connector constituent 7 is fixed to the cylinder head 2 by using the bolt 75. Thus, the cylinder head 2, the first connector constituent 3, the second connector constituent 5 and the third connector constituent 7 become integral with one another under a strong force.

According to the connector 1 according to the first embodiment, a configuration is such that when the third connector constituent 7 is installed over the preinstalled second connector constituent 5, the locked-portion holding portion 19 of the third connector constituent 7 keeps the locked portion 15 locked to the locking portion 11. Thus, the second connector constituent 5 is restrained and fixed to the first connector constituent 3, and thus, even if vibrations are applied under a condition where the second connector constituent 5 and the third connector constituent 7 are installed in the first connector constituent 3, the connector constituents 3, 5, 7 are not easily disjoined from one another thereby to enable ensuring the fitting of the first terminal 9 to the second terminal 13. Then, the occurrence of sliding movement between points of contact between the first terminal 9 and the second terminal 13 can be suppressed, which thus improves vibration resistance and electrical contact characteristics.

According to the connector 1 according to the first embodiment, moreover, as is the case with the connector of the second conventional example disclosed in Japanese Patent Application No. 2012-280784, the connector 1 can become simpler in configuration as compared to the connector of the first conventional example disclosed in US 2010/0003841 A1.

According to the connector 1 according to the first embodiment, moreover, under a condition where the second connector constituent 5 is installed in the first connector constituent 3, the first cylindrical portion 23 of the second connector constituent 5 enters the inside of the first cylindrical portion 21 of the first connector constituent 3 so that the first cylindrical portions 23, 21 are fitted to each other. Thus, even if vibrations are applied under a condition where the second connector constituent 5 and the third connector constituent 7 are installed in the first connector constituent 3, the occurrence of sliding movement between the points of contact between the terminals (i.e. the first terminal 9 and the second terminal 13) can be further suppressed, which thus achieves further improvements in the vibration resistance and the electrical contact characteristics.

According to the connector 1 according to the first embodiment, moreover, a configuration is such that under a condition where the third connector constituent 7 is installed over the preinstalled second connector constituent 5, the elastic arm 31 is elastically deformed outward so as to keep the locked portion 15 locked to the locking portion 11. Thus, the third connector constituent 7 is biased by the elastic arm 31, so that vibrations generated in the third connector constituent 7 can be suppressed.

Figure 9:
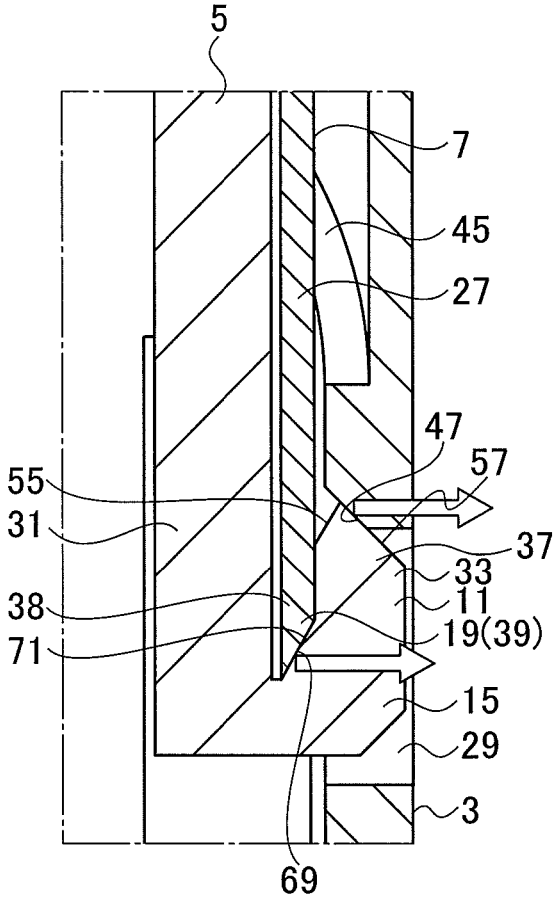
FIG. 9 is an enlarged view of a part IX of FIG. 8.

According to the connector 1, moreover, in a state of completion of installation of the third connector constituent 7 over the preinstalled second connector constituent 5, as indicated by arrows in FIG. 9, the chamfered surface 69 presses against the chamfered surface 71 and the chamfered surface 57 presses against the chamfered surface 47, which thus eliminates rattling of the connector constituents 3, 5, 7 with respect to one another.

In the connector 1 according to the first embodiment, moreover, the second connector constituent 5 is provided rotatably relative to the third connector constituent 7 and is provided with the guide rib 59, and the first connector constituent 3 is provided with the guide rail surface 45 as the rotation direction guide portion configured to guide the guide rib 59 to a normal position of rotation, even if the guide rib 59 is located at any position of rotation, before the first terminal 9 and the second terminal 13 reach a position at which the terminals 9, 13 start contacting each other. Thus, even if the second connector constituent 5 and the first connector constituent 3 start fitting together when they are not in the normal position of fitting rotation, the guide rib 59 and the guide rail surface 45 allow the second connector constituent 5 and the first connector constituent 3 to reach the normal position of fitting rotation, before the first terminal 9 and the second terminal 13 reach a position at which the terminals 9, 13 start connecting to each other. Thus, this enables an easy operation for fitting the first connector constituent 3 and the second connector constituent 5 together even if the position of rotation of the second connector constituent 5 relative to the first connector constituent 3 cannot be seen.

In the connector 1 according to the first embodiment, moreover, the rotation direction guide portion is configured as the guide rail surface 45 formed on an upper end surface of the first cylindrical portion 21 of the first connector constituent 3, as an inclined surface which is highest in level at a position facing the normal position of rotational fitting and is lowest in level at the normal position of rotational fitting. Thus, the second connector constituent 5 has a maximum angle of rotation of 180°, and hence a perimeter of a semicircumference of the second connector constituent 5, at the maximum, is sufficient for the maximum amount of twisting of the electric wires within the second connector constituent 5 and the third connector constituent 7. Thus, an excess of a length of the electric wire can be reduced, as compared to that in a structure in which the second connector constituent 5 is rotated 360°.

According to the connector 1 according to the first embodiment, moreover, the third connector constituent 7 is rotatable relative to the second connector constituent 5, and thus, the orientation of the third terminal 17 can be set to a desired orientation in order that the wire harness is connected to the third terminal 17.

According to the connector 1 according to the first embodiment, moreover, the rotation restraining portion configured to restrain excessive rotation of the second connector constituent 5 relative to the third connector constituent 7 is provided to thus enable preventing the electric wire from becoming damaged (for example, being broken) due to the excessive rotation.

In the first embodiment, the second connector constituent 5 is provided with the guide rib 59, and the first connector constituent 3 is provided with the guide rail surface 45; however, conversely, the first connector constituent 3 may be provided with the guide rib, and the second connector constituent 5 may be provided with the guide rail surface.

Second Embodiment

A connector 1*a* according to a second embodiment will be described with reference to FIGS. 10 to 21.

The connector 1*a* according to the second embodiment is different from the connector 1 according to the first embodiment mainly in configurations of a locking portion 11*a*, a locked portion 15*a* and a locked-portion holding portion 19*a*, and the remaining portions are configured in substantially the same manner as those of the connector 1 according to the first embodiment and achieve substantially the same advantageous effects.

In the connector 1*a* according to the second embodiment, a first connector constituent 3*a* includes a second cylindrical portion 77 in addition to a first cylindrical portion 21*a*.

A second connector constituent 5*a* includes, in addition to a first cylindrical portion 23*a*, a second cylindrical portion 25*a* having an inside diameter slightly larger than an outside diameter of the second cylindrical portion 77 of the first connector constituent 3*a*. A third connector constituent 7*a* includes a first cylindrical portion 27*a* having an inside diameter slightly larger than an outside diameter of the second cylindrical portion 25*a* of the second connector constituent 5*a*.

The locking portion 11*a* is formed of a recess portion 79 provided in the second cylindrical portion 77 of the first connector constituent 3*a*. Note that the locking portion 11*a* may be formed of a through-hole, as is the case with the first embodiment. The locked portion 15*a* includes an elastic arm 31*a*.

The elastic arm 31*a* is formed in a cantilever shape by providing a cutout 81 to the second cylindrical portion 25*a* of the second connector constituent 5*a*. The cutout 81 is formed in a U shape formed of a pair of slits in close proximity to each other, and a short slit linking end portions of the pair of slits together. The pair of slits extend long in the direction of extension of the central axis C1 of the second cylindrical portion 25*a* of the second connector constituent 5*a*, and are spaced apart with a slight gap in between in a peripheral direction of the second cylindrical portion 25*a* of the second connector constituent 5*a*. The short slit and the pair of slits are formed in a manner extending through a heavy portion of the second cylindrical portion 25*a* of the second connector constituent 5*a*. The short slit is provided at upper ends of the pair of slits.

Then, a portion 83 of the elastic arm 31*a* slightly protrudes inward under no external force applied.

Figure 16:
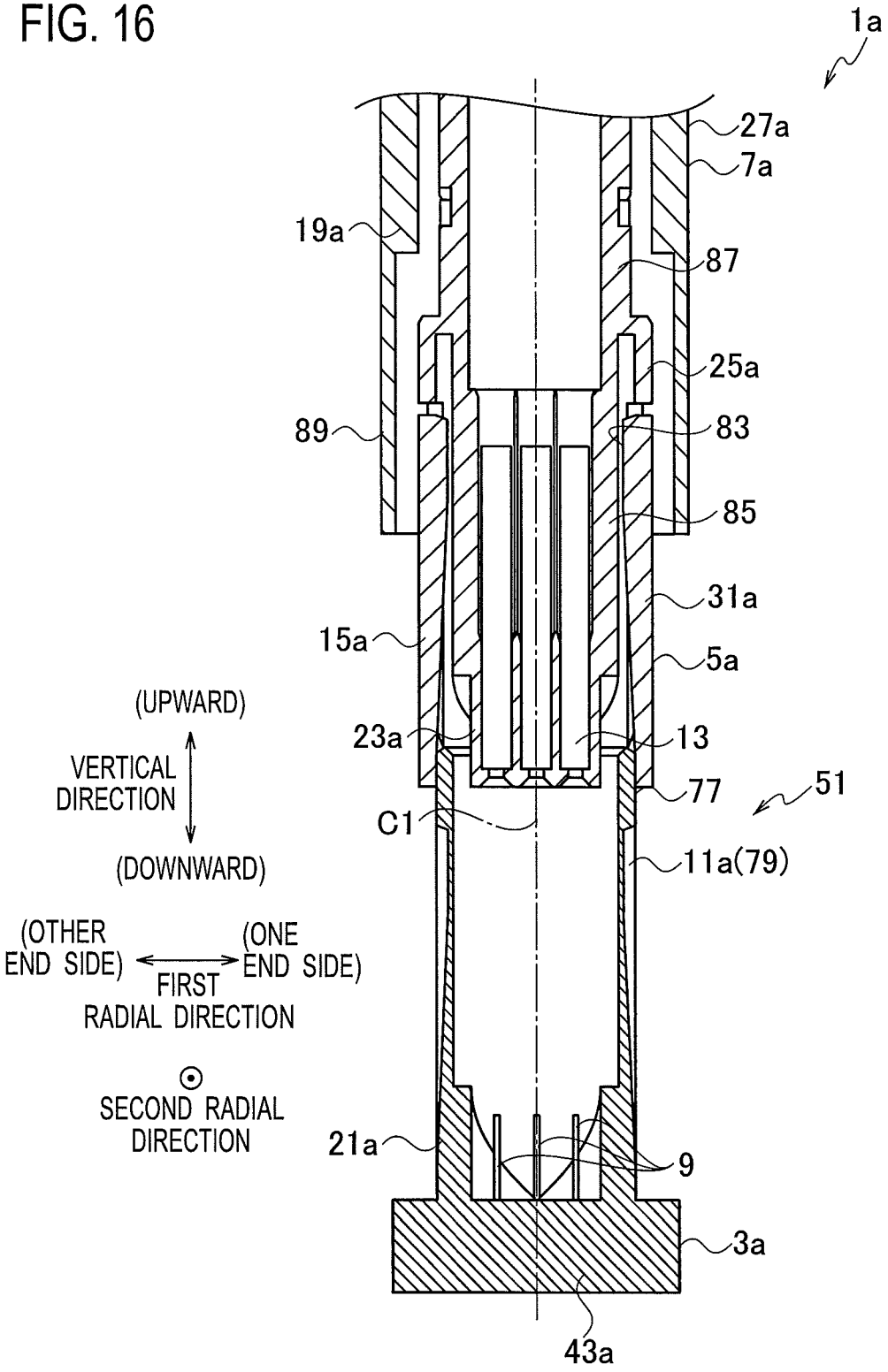
FIG. 16 is a view illustrating a state in which the second connector constituent and the third connector constituent are in process of being installed in the first connector constituent of the connector according to the second embodiment.
Figure 21:
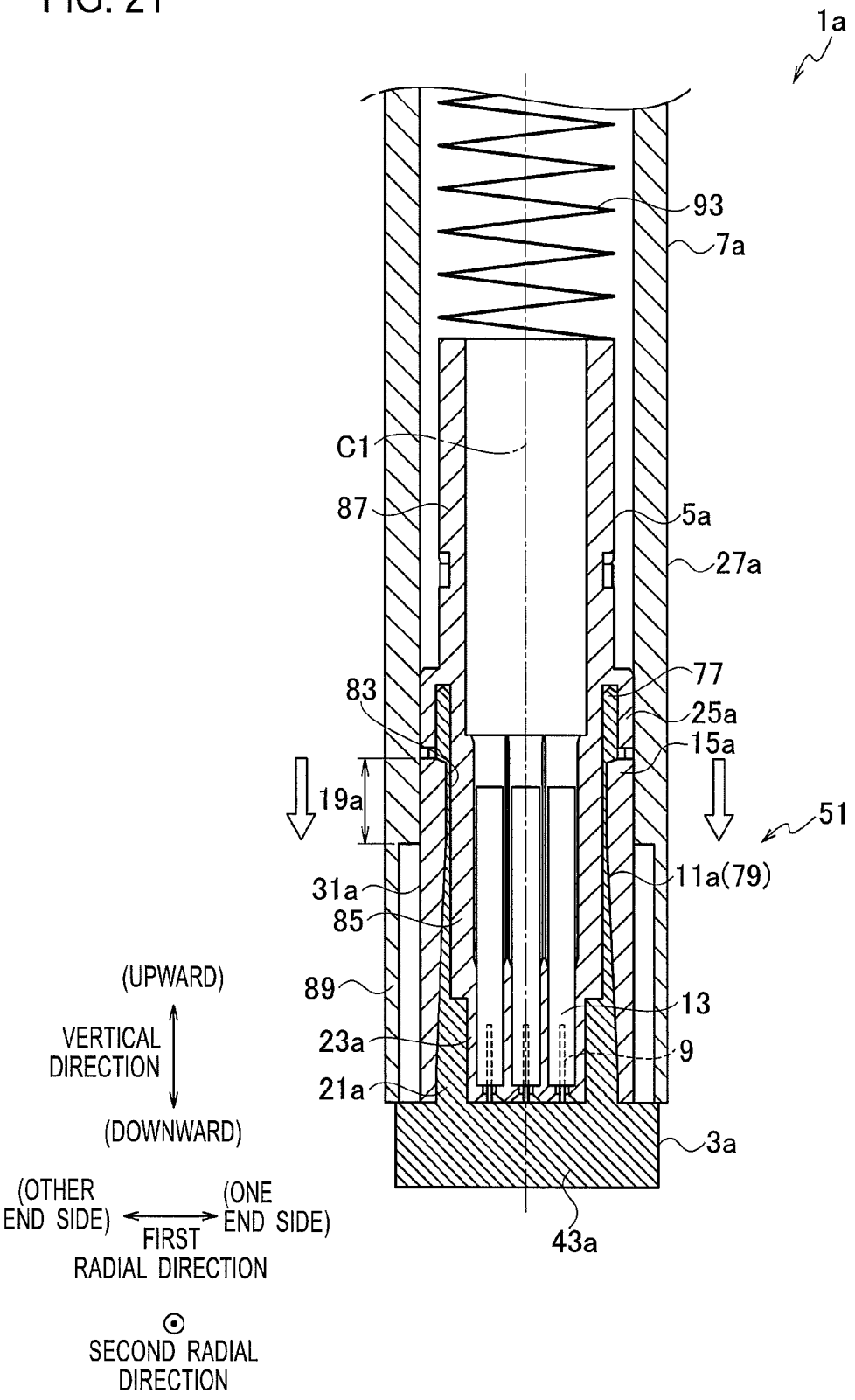
FIG. 21 is a view illustrating a state of completion of installation of the second connector constituent and the third connector constituent in the first connector constituent of the connector according to the second embodiment.
Figure 22:
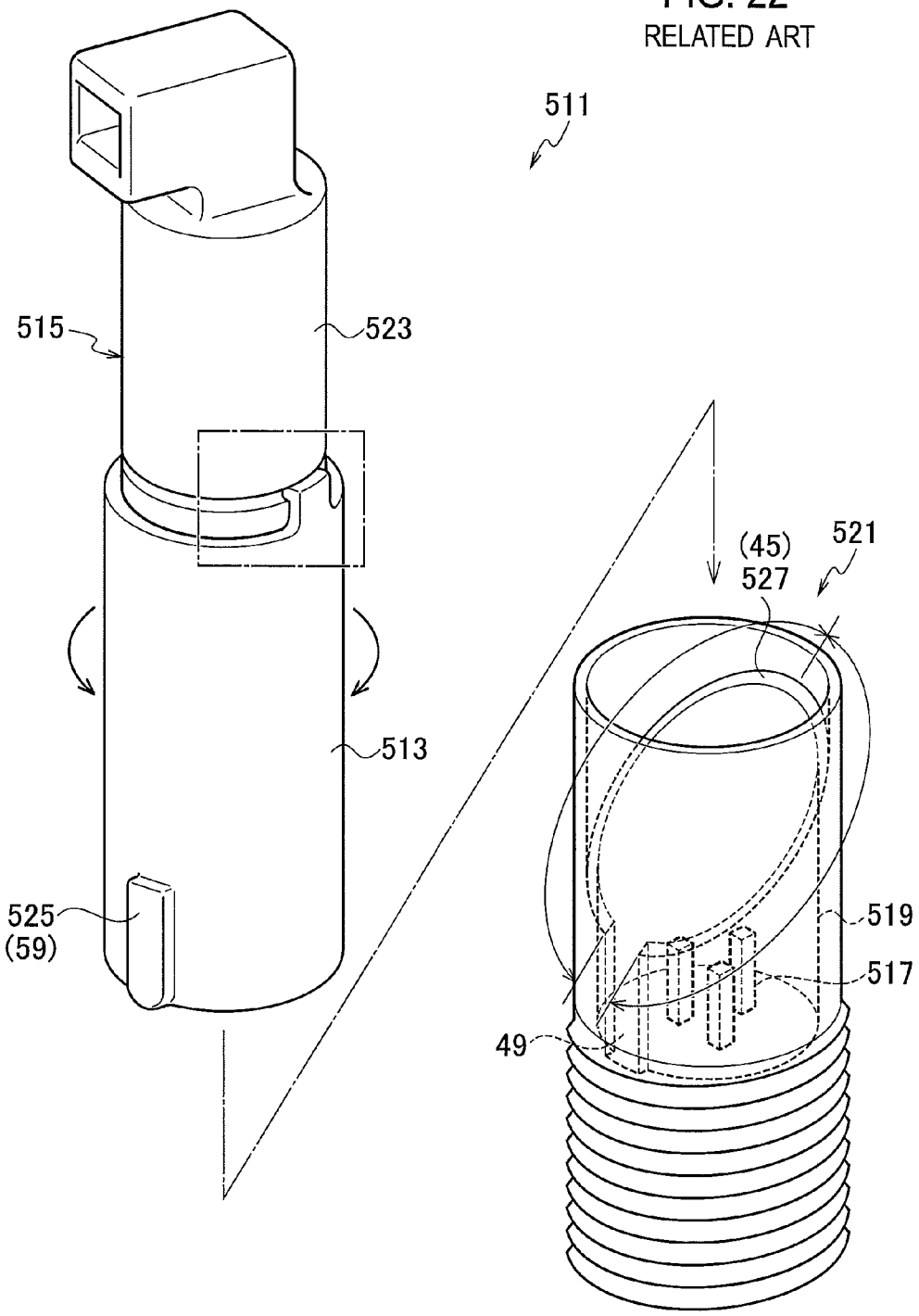
FIG. 22 RELATED ART
FIG. 22 is a view illustrating a connector of a second conventional example.
Figure 23:
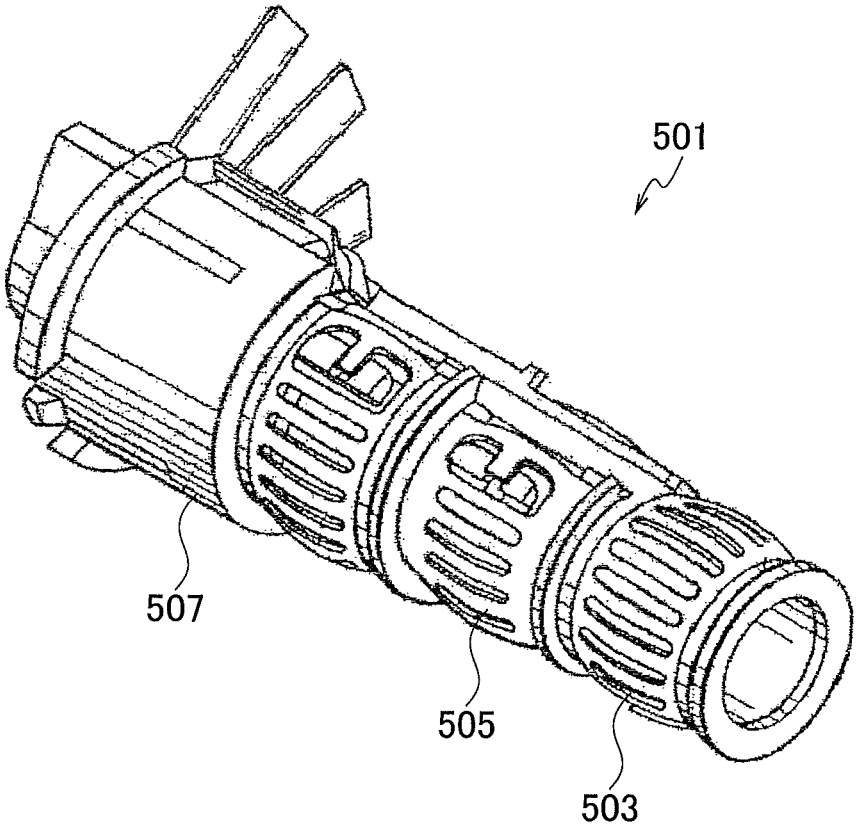
FIG. 23 RELATED ART
FIG. 23 is a view illustrating a connector of a first conventional example.

Specifically, the portion 83 protrudes closer to the central axis C1 of the second cylindrical portion 25*a* of the second connector constituent 5*a*, inward of an inner wall of the second cylindrical portion 25*a* of the second connector constituent 5*a*, by a value slightly smaller than a value of a thickness of a heavy portion of the second cylindrical portion 77 of the first connector constituent 3*a* (see FIGS. 16 and 21).

It is assumed here that the locked portions 15*a* (or the elastic arms 31*a*) are symmetrically disposed with respect to the central axis C1 of the second cylindrical portion 25*a* of the second connector constituent 5*a*. Under no external force applied, a value of a distance between the portions 83 protruding inward of a pair of the elastic arms 31*a* is smaller than a value of the outside diameter of the second cylindrical portion 77 of the first connector constituent 3*a* and is slightly larger than a value of an inside diameter of the second cylindrical portion 77 of the first connector constituent 3*a*.

A portion (e.g. a tip portion) of the first cylindrical portion 27*a* of the third connector constituent 7*a* forms the locked-portion holding portion 19*a* (see FIG. 21).

Figure 17:
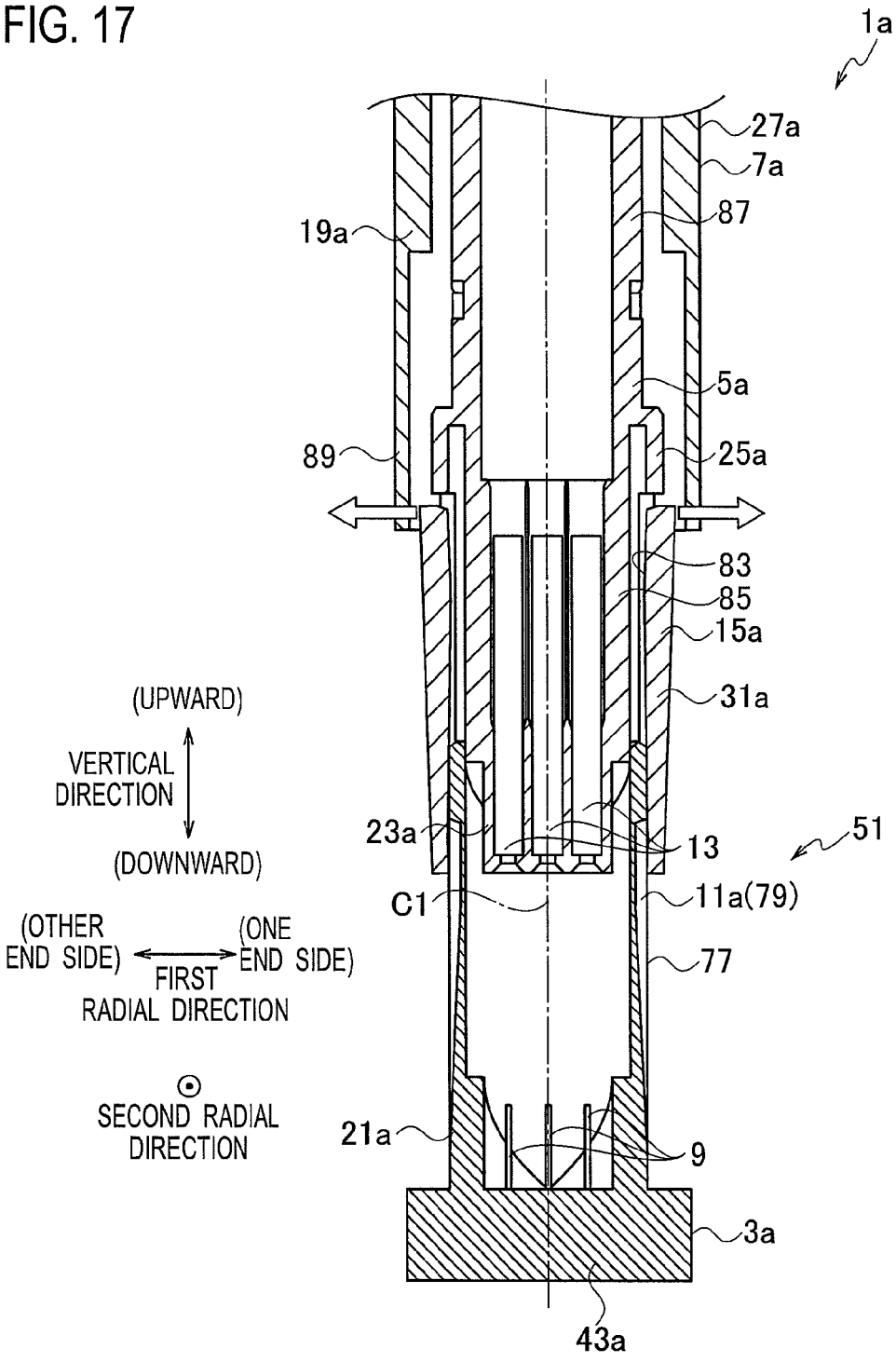
FIG. 17 is a view illustrating a state in which the second connector constituent and the third connector constituent are in process of being installed in the first connector constituent of the connector according to the second embodiment.
Figure 18:
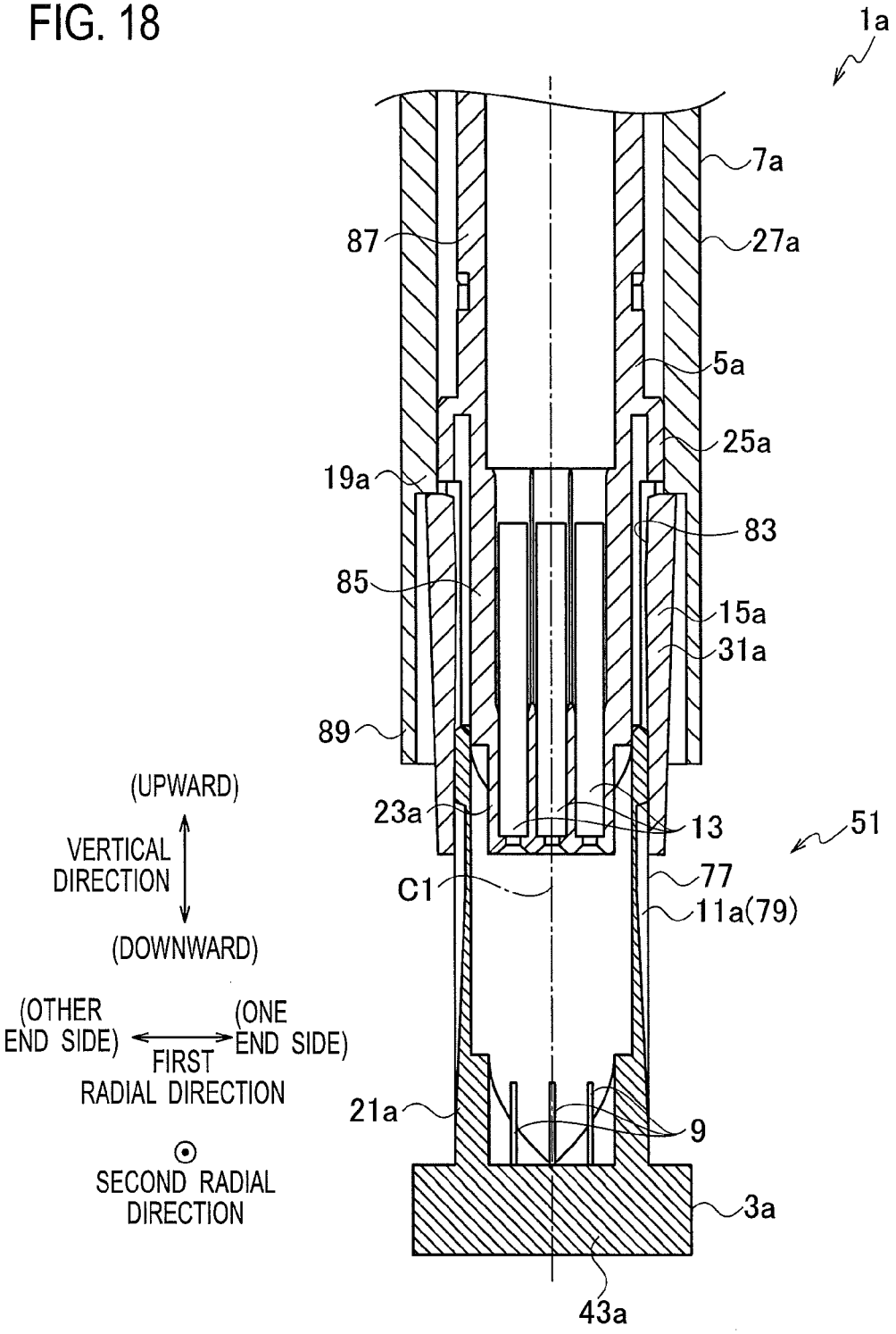
FIG. 18 is a view illustrating a state in which the second connector constituent and the third connector constituent are in process of being installed in the first connector constituent of the connector according to the second embodiment.
Figure 19:
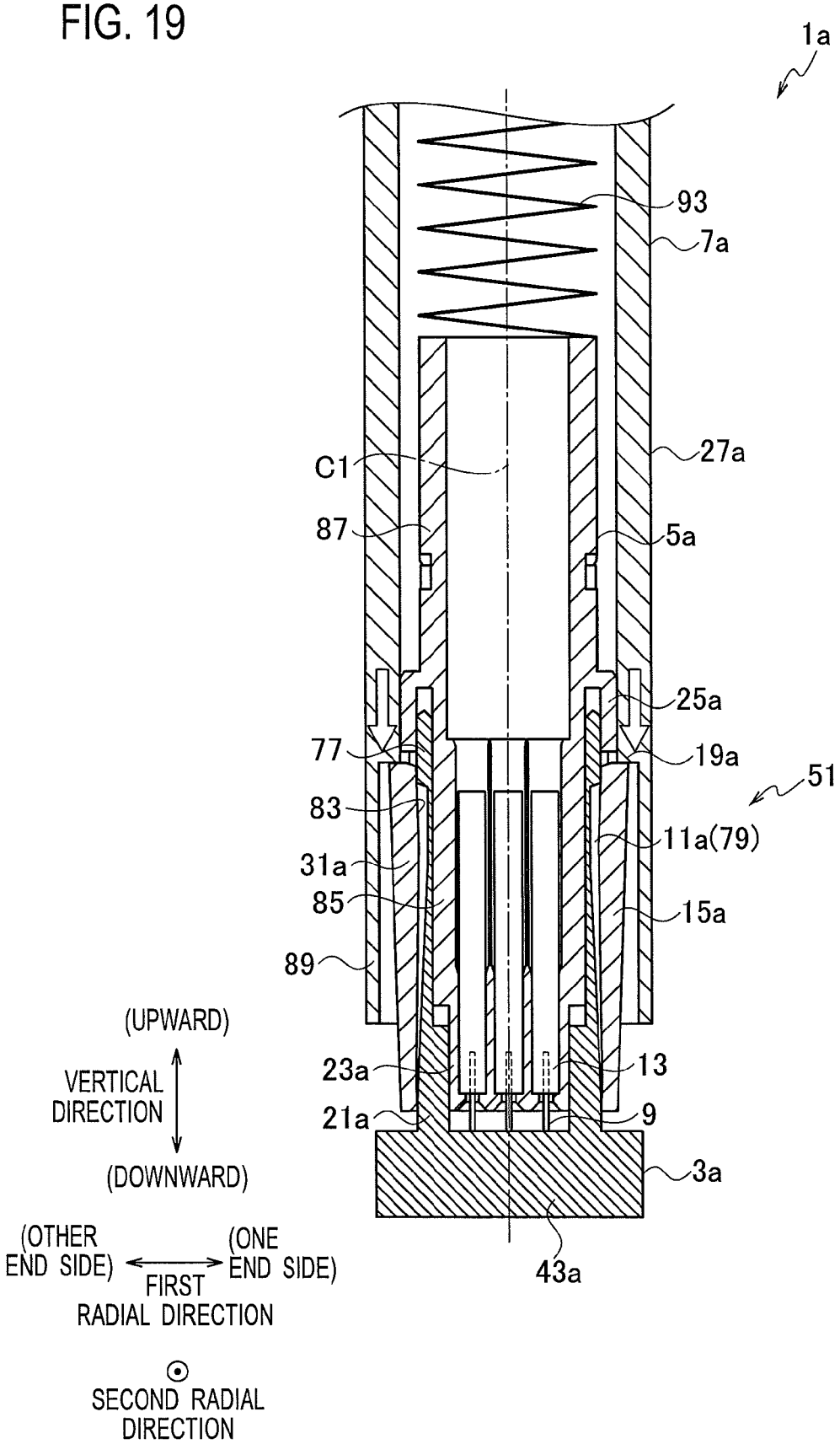
FIG. 19 is a view illustrating a state in which the second connector constituent and the third connector constituent are in process of being installed in the first connector constituent of the connector according to the second embodiment.

Under a condition where the second connector constituent 5*a* is in process of being installed over the first connector constituent 3*a*, the elastic arm 31*a* is elastically deformed outward by being pressed by the second cylindrical portion 77 of the first connector constituent 3*a* (see FIGS. 17 to 19).

Figure 20:
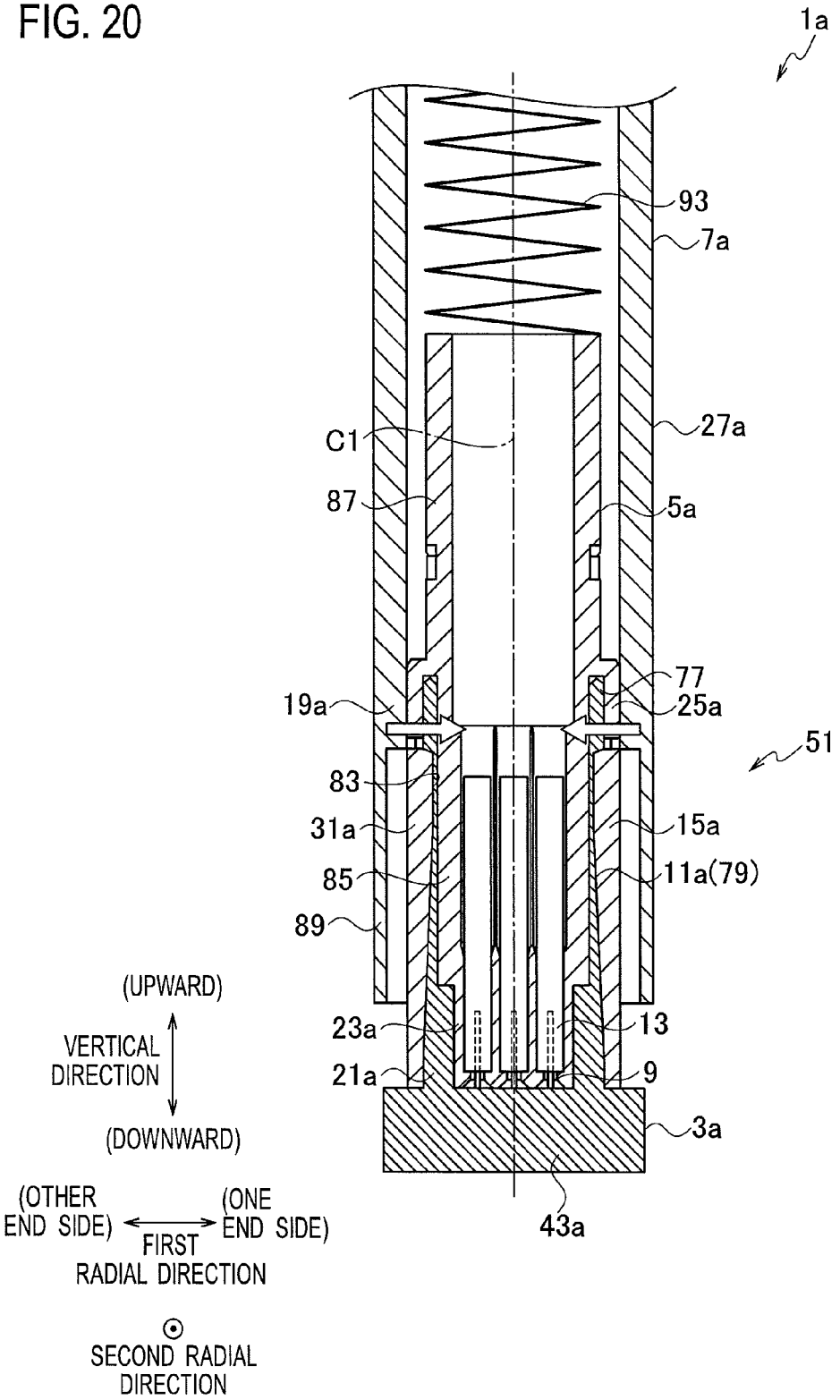
FIG. 20 is a view illustrating a state in which the second connector constituent and the third connector constituent are in process of being installed in the first connector constituent of the connector according to the second embodiment.

At the completion of installation of the second connector constituent 5*a* over the first connector constituent 3*a*, the elastic arm 31*a* is restored to its original state, and the portion 83 protruding inward of the elastic arm 31*a* enters the recess portion 79 which forms the locking portion 11*a*, so that the locked portion 15*a* is locked to the locking portion 11*a* (see FIG. 20).

At the completion of installation of the third connector constituent 7*a* over the second connector constituent 5*a* installed over the first connector constituent 3*a* (or the preinstalled second connector constituent 5*a*), the central axes C1 of all the cylindrical portions 21*a*, 23*a*, 25*a*, 27*a*, 77 coincide with one another. Thus, the second cylindrical portion 77 (or the first cylindrical portion 21*a*) of the first connector constituent 3*a* enters the inside of the second cylindrical portion 25*a* of the second connector constituent 5*a*, and the second cylindrical portion 25*a* of the second connector constituent 5*a* enters the inside of the first cylindrical portion 27*a* of the third connector constituent 7*a* (see FIG. 21).

The elastic arm 31*a* enters the inside of the locked-portion holding portion 19*a*, and thereby, an upper portion of the elastic arm 31*a* abuts an inner surface of the locked-portion holding portion 19*a* and thus cannot become deformed outward (or in a direction away from the central axis C1), so that the locked portion 15*a* is kept locked to the locking portion 11*a*.

In the connector 1*a*, the locked portion 15*a* is elastically deformed under a condition where the second connector constituent 5*a* is in process of being installed over the first connector constituent 3*a*, and at the completion of the installation of the second connector constituent 5*a* over the first connector constituent 3*a*, the locked portion 15*a* is restored to its original state, and the locked portion 15*a* is locked to the locking portion 11*a*. The third connector constituent 7*a* is installed over the preinstalled second connector constituent 5*a*, and thereby, the locked-portion holding portion 19*a* engages the locked portion 15*a*. The locked-portion holding portion 19*a* engages the locked portion 15*a*, and thereby, the locked portion 15*a* is maintained in its state locked to the locking portion 11*a*.

Even if the locked-portion holding portion 19*a* engages the locked portion 15*a*, this engagement does not cause deformation in the locked portion 15*a*, and the locked portion 15*a* is maintained in its state locked to the locking portion 11*a*. So long as the locked-portion holding portion 19*a* engages the locked portion 15*a*, the locked portion 15*a* remains in its state engaged with the locking portion 11*a* without becoming deformed, so that the locked portion 15*a* is held in its state engaged with and locked to the locking portion 11*a*.

The connector 1*a* will now be described in further detail.

The first connector constituent 3*a* is integrally installed with the cylinder head 2 by a male screw (not illustrated) in the same manner as the connector 1 according to the first embodiment.

The second connector constituent 5*a* is rotatable (for example, at plus or minus 180°) with respect to the third connector constituent 7*a* about the central axis C1. The rotation positioning portion 51 is provided, and the rotation positioning portion 51 is configured to engage the second connector constituent 5*a* to the first connector constituent 3*a* and thereby effect rotation positioning of the second connector constituent 5*a*, when installing the second connector constituent 5*a* and the third connector constituent 7*a* over the first connector constituent 3*a* installed in the cylinder head 2. The rotation positioning portion 51 guides the second connector constituent 5*a* to the first connector constituent 3*a* so that the second connector constituent 5*a* is located at a normal position of fitting to the first connector constituent 3*a*.

The first connector constituent 3*a* includes the first cylindrical portion 21*a*, the second cylindrical portion 77, and a bottom wall portion 43*a*. The central axis C1 of the first cylindrical portion 21*a* and the central axis C1 of the second cylindrical portion 77 coincide with each other. An inside diameter of the second cylindrical portion 77 is larger than an inside diameter of the first cylindrical portion 21*a*. An outside diameter of the second cylindrical portion 77 is equal to an outer diameter of the first cylindrical portion 21*a*. The second cylindrical portion 77 is connected to an upper side of the first cylindrical portion 21*a*.

The bottom wall portion 43*a* closes a lower end of the first cylindrical portion 21*a* of the first connector constituent 3*a*. The inside of the first cylindrical portion 21*a* of the first connector constituent 3*a* forms a terminal fitting chamber, and the first terminal 9 protrudes upward from the bottom wall portion 43*a*.

On a lower side of the bottom wall portion 43*a*, a male screw portion (not illustrated) is formed in order to install the first connector constituent 3*a* in the cylinder head 2. The ignition device such as the glow plug is provided within the male screw portion.

The recess portion 79 which forms the locking portion 11*a* is provided on an outer periphery of the second cylindrical portion 77 of the first connector constituent 3*a* and first cylindrical portion 21*a*, and is recessed toward an inner periphery from the outer periphery of the cylindrical portions 77, 21*a*. The recess portion 79 is formed in a rectangular shape, and its width direction (or predetermined narrow width direction) coincides with the second radial direction, and the recess portion 79 extends long in the vertical direction of the first cylindrical portion 21*a* of the first connector constituent 3*a*. A depth of the recess portion 79 is deep on its upper side and becomes gradually shallower closer to its lower side. Therefore, a bottom surface of the recess portion 79 forms an inclined surface.

A pair of recess portions 79, for example, are provided. The pair of recess portions 79 are arranged symmetrically with respect to the central axis C1 in a vertically intermediate portion between the second cylindrical portion 77 of the first connector constituent 3*a* and the first cylindrical portion 21*a*. The pair of recess portions 79 are arranged on one end side and the other end side in the first radial direction.

The second connector constituent 5*a* includes the first cylindrical portion 23*a*, the second cylindrical portion 25*a*, a cylindrical lower body portion 85, and a cylindrical upper body portion 87.

An outside diameter of the first cylindrical portion 23*a* of the second connector constituent 5*a* is slightly smaller than an inside diameter of the first cylindrical portion 21*a* of the first connector constituent 3*a*. A vertical dimension of the first cylindrical portion 23*a* of the second connector constituent 5*a* is substantially equal to a vertical dimension of the first cylindrical portion 21*a* of the first connector constituent 3*a*.

An outside diameter of the lower body portion 85 is slightly smaller than an inside diameter of the second cylindrical portion 77 of the first connector constituent 3*a*. A vertical dimension of the lower body portion 85 is substantially equal to a vertical dimension of the second cylindrical portion 77 of the first connector constituent 3*a*.

An inside diameter of the second cylindrical portion 25*a* of the second connector constituent 5*a* is slightly larger than the outside diameters of the cylindrical portions 21*a*, 77 of the first connector constituent 3*a*. A vertical dimension of the second cylindrical portion 25*a* of the second connector constituent 5*a* is substantially equal to the sum of vertical dimensions of the cylindrical portions 21*a*, 77 of the first connector constituent 3*a*.

An outside diameter of the upper body portion 87 of the second connector constituent 5*a* is smaller than the outside diameter of the second cylindrical portion 77 of the first connector constituent 3*a* and is larger than the inside diameter of the second cylindrical portion 77 of the first connector constituent 3*a*.

The central axes C1 of the cylindrical portions 23*a*, 25*a*, 85, 87 coincide with one another. The lower body portion 85 is connected to an upper side of the first cylindrical portion 23*a* of the second connector constituent 5*a*. The upper body portion 87 is connected to an upper side of the lower body portion 85. The second cylindrical portion 25*a* of the second connector constituent 5*a* extends out downward from a boundary portion between the upper body portion 87 and the lower body portion 85. In the vertical direction, the position of a lower end of the second cylindrical portion 25*a* of the second connector constituent 5*a* coincides substantially with the position of a lower end of the first cylindrical portion 23*a* of the second connector constituent 5*a*. The first cylindrical portion 23*a* of the second connector constituent 5*a* and the lower body portion 85 are present on the inside of the second cylindrical portion 25*a* of the second connector constituent 5*a*.

The second terminal 13 is provided on the lower end of the first cylindrical portion 23*a* within the first cylindrical portion 23*a* of the second connector constituent 5*a*.

The locked portion 15*a* is formed of the portion 83 of the elastic arm 31*a*. The amount of protrusion of the portion 83 toward the center of the second cylindrical portion 25*a* of the second connector constituent 5*a* gradually increases from the proximal end (or lower end) the cantilever-shaped elastic arm 31*a* toward the distal end (or upper end) thereof. Note that the portion 83 does not reach the lower body portion 85. The amount of protrusion changes, and thereby, an inclined surface is formed on the inside of the elastic arm 31*a*.

Under a condition where the second connector constituent 5*a* is installed over the first connector constituent 3*a* (or in a state of the preinstalled second connector constituent 5*a*), as illustrated in FIG. 20, the first cylindrical portion 23*a* of the second connector constituent 5*a* enters the first cylindrical portion 21*a* of the first connector constituent 3*a*, the lower body portion 85 of the second connector constituent 5*a* enters the second cylindrical portion 77 of the first connector constituent 3*a*, the second cylindrical portion 77 and the first cylindrical portion 21*a* of the first connector constituent 3*a* enter the second cylindrical portion 25*a* of the second connector constituent 5*a*, the portion 83 of the elastic arm 31*a* of the second connector constituent 5*a* enters the recess portion 79 of the second cylindrical portion 77 of the first connector constituent 3*a*, and the inclined surface of the portion 83 is in surface contact with the inclined surface of the bottom surface of the recess portion 79. Then, the locked portion 15*a* of the second connector constituent 5*a* is engaged with and locked to the locking portion 11*a* of the first connector constituent 3*a*.

In the preinstalled second connector constituent 5*a*, a tip end (or lower end) of the first cylindrical portion 23*a* of the second connector constituent 5*a* abuts the bottom wall portion 43*a* of the first connector constituent 3*a*, a lower end of the lower body portion 85 abuts a lower end of the second cylindrical portion 77, a lower end of the second cylindrical portion 25*a* of the second connector constituent 5*a* abuts the bottom wall portion 43*a* of the first connector constituent 3*a*, and the second terminal 13 of the second connector constituent 5*a* is connected to the first terminal 9 of the first connector constituent 3*a*.

The second connector constituent 5*a* reaches a normal position of rotational fitting relative to the first connector constituent 3*a*, before the first terminal 9 and the second terminal 13 start contacting each other.

The third connector constituent 7*a* includes the first cylindrical portion 27*a*, a second cylindrical portion 89, the body portion 63, the mounting arm portion 65, and the terminal placement portion 67.

The inside diameter of the cylindrical portion 27*a* of the third connector constituent 7*a* is slightly larger than the outside diameter of the second cylindrical portion 25*a* of the second connector constituent 5*a*. The inside diameter of the second cylindrical portion 89 is larger than the inside diameter of the cylindrical portion 27*a*. The outside diameter of the second cylindrical portion 89 coincides with the outside diameter of the cylindrical portion 27*a*.

A vertical dimension of the second cylindrical portion 89 of the third connector constituent 7*a* is equal to a dimension between the lower end of the first cylindrical portion 21*a* of the first connector constituent 3*a* and a vertically intermediate portion of the elastic arm 31*a* of the second connector constituent 5*a*.

The central axis C1 of the second cylindrical portion 89 of the third connector constituent 7*a* coincides with the central axis C1 of the first cylindrical portion 27*a* of the third connector constituent 7*a*. The first cylindrical portion 27*a* is connected to the second cylindrical portion 89 on its upper side.

The body portion 63 closes an upper end of the first cylindrical portion 27*a* of the third connector constituent 7*a*, and protrudes by a predetermined distance downward from the upper end of the first cylindrical portion 27*a*. The body portion 63 also protrudes by a predetermined distance upward from the upper end of the first cylindrical portion 27*a*.

The mounting arm portion 65 is provided in a manner protruding from a portion of the body portion 63 protruding by the predetermined distance upward from the upper end of the first cylindrical portion 27*a*, toward one end in the first radial direction. The terminal placement portion 67 is arranged on the body portion 63 on its upper side. The third terminal 17 is provided within the terminal placement portion 67. The terminal placement portion 67 is open at one end side in the second radial direction so that the wire harness installed in the terminal placement portion 67 (or the third terminal 17) extends out toward one end in the second radial direction.

The cylinder head 2 is provided with the recess portion 73 opening upward. The connector 1*a* installed in the cylinder head 2 is configured in such a manner that its portion above the mounting arm portion 65, inclusive of the mounting arm portion 65, protrudes upward from the recess portion 73, and its portion below the mounting arm portion 65 is present in the recess portion 73.

A bottom surface of the recess portion 73 of the cylinder head 2 is provided with internal threads (not illustrated) into which external threads (not illustrated) of the first connector constituent 3*a* are screwed.

In the connector 1*a* installed in the cylinder head 2, the mounting arm portion 65 is in contact with a peripheral portion of the recess portion 73 of the cylinder head 2. The mounting arm portion 65 (or the third connector constituent 7) is fixed to the cylinder head 2 by the fastening member 75 such as a mounting screw (or a bolt).

The connector 1*a* is provided with a cylindrical rotating member (or an intermediate connector constituent) 91 and a compression coil spring 93 as an example of an elastic body.

The rotating member 91 is arranged on the inside of the first cylindrical portion 27*a* of the third connector constituent 7*a*, and is engaged with the body portion 63 protruding inward of the first cylindrical portion 27*a*. A central axis of the rotating member 91 coincides with the central axis C1 of the first cylindrical portion 27*a*. The rotating member 91 is adapted to rotate relative to the third connector constituent 7*a* about the central axis C1 of the first cylindrical portion 27*a*, and is adapted to be movable also in the vertical direction.

The second connector constituent 5*a* is engaged with the rotating member 91. The second connector constituent 5*a* is adapted to rotatable relative to the rotating member 91 about the central axis C1 of the first cylindrical portion 27*a*, and is adapted to be movable also in the vertical direction.

The rotating member 91 and the third connector constituent 7*a* are provided with a rotation restraining portion (not illustrated). The second connector constituent 5*a* and the rotating member 91 are also provided with a rotation restraining portion (not illustrated).

Thus, the rotating member 91 rotates relative to the third connector constituent 7*a*, around the central axis C1, within a predetermined range of angles (for example, a range of plus or minus 90° alone), and the second connector constituent 5*a* also rotates relative to the rotating member 91, around the central axis C1, within a predetermined range of angles (for example, a range of plus or minus 90° alone).

The rotating member 91 and the third connector constituent 7*a* are provided with a vertical movement restraining portion (not illustrated). The second connector constituent 5*a* and the rotating member 91 are also provided with a vertical movement restraining portion (not illustrated).

Thus, the rotating member 91 moves relative to the third connector constituent 7*a* by a predetermined distance in the vertical direction, and the second connector constituent 5*a* also moves relative to the rotating member 91 by a predetermined distance in the vertical direction.

The compression coil spring 93 is provided within the first cylindrical portion 27*a* of the third connector constituent 7*a* and also between the body portion 63 and the second connector constituent 5*a*. The compression coil spring 93 biases the second connector constituent 5*a* downward.

By such biasing, under a condition before the second connector constituent 5*a* is installed over the first connector constituent 3*a* installed in the cylinder head 2, the rotating member 91 is located at the lowest position relative to the third connector constituent 7*a*, and the second connector constituent 5*a* is located at the lowest position relative to the rotating member 91.

Moreover, by such biasing, the rotating member 91 is located at a default position of rotation (or a rotation position which permits rotation of 90° alone in both forward and reverse directions) relative to the third connector constituent 7*a*, and the second connector constituent 5*a* is located at a default position of rotation relative to the rotating member 91.

Therefore, the second connector constituent 5*a* is located at a default position of rotation relative to the third connector constituent 7*a*, and the second connector constituent 5*a* can rotate 180° (or plus or minus 180°) alone in both forward and reverse directions) relative to the third connector constituent 7*a*.

Next, description will be given with regard to assembly operation for installing the second connector constituent 5*a* and the third connector constituent 7*a* over the first connector constituent 3*a* installed in the cylinder head 2.

Figure 10:
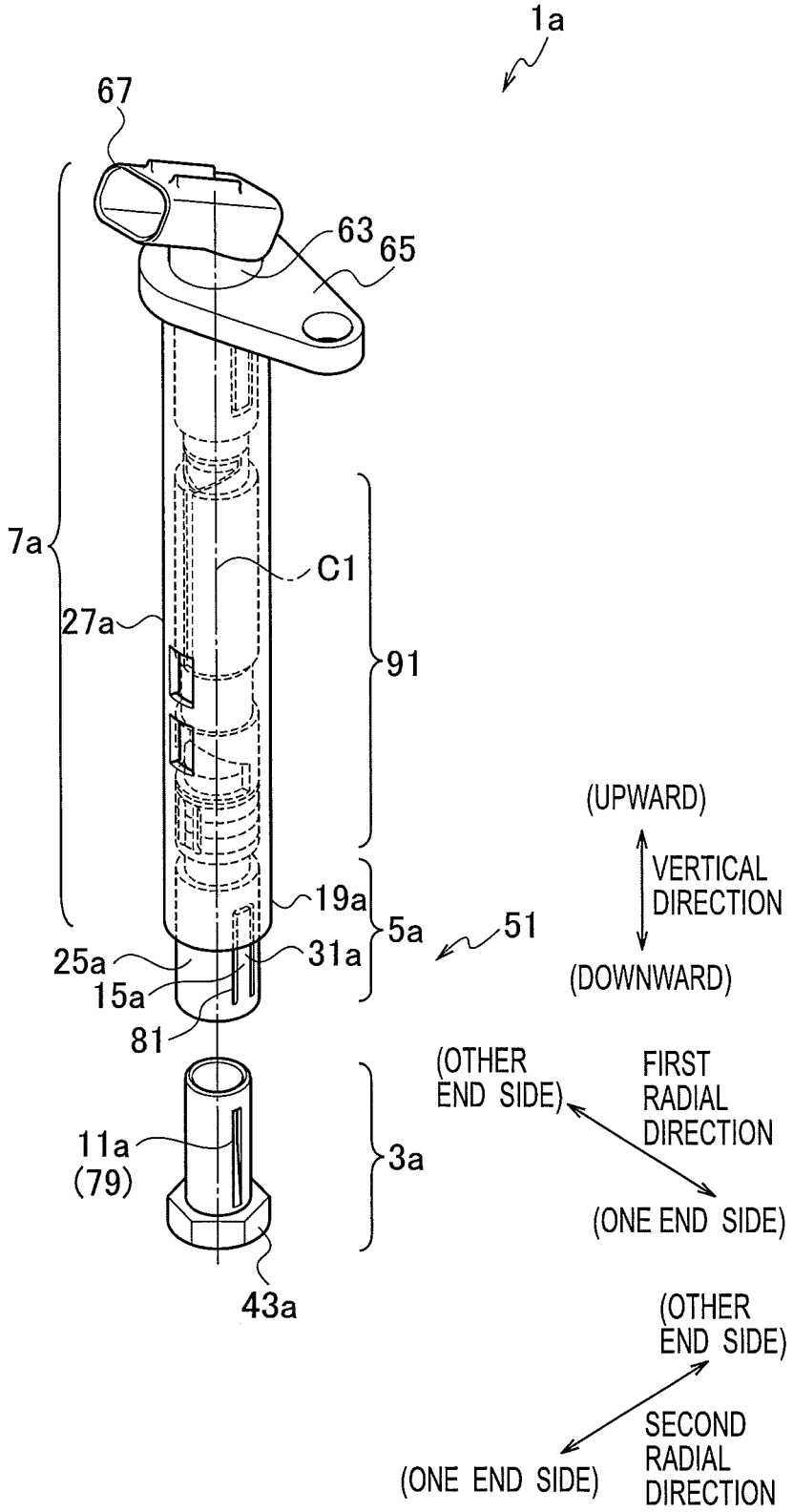
FIG. 10 is a perspective view of a connector according to a second embodiment.
Figure 11:
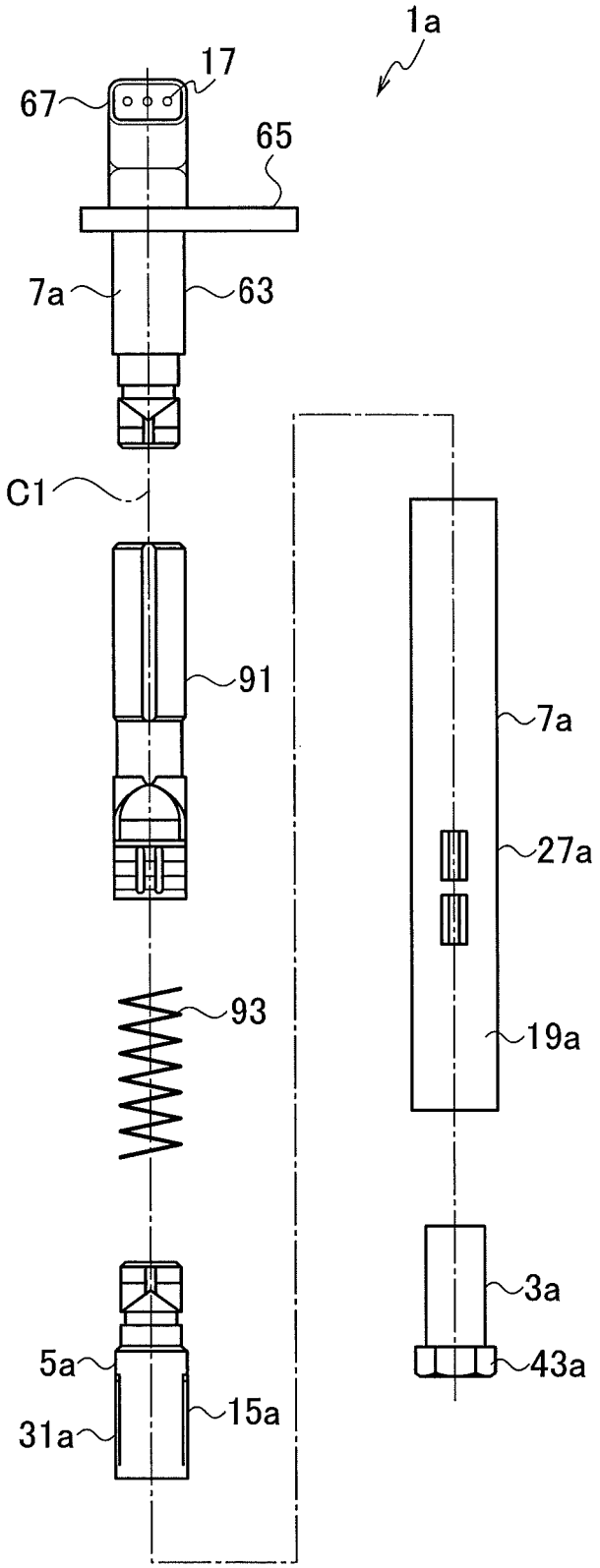
FIG. 11 is an exploded view of the connector according to the second embodiment.
Figure 12A:
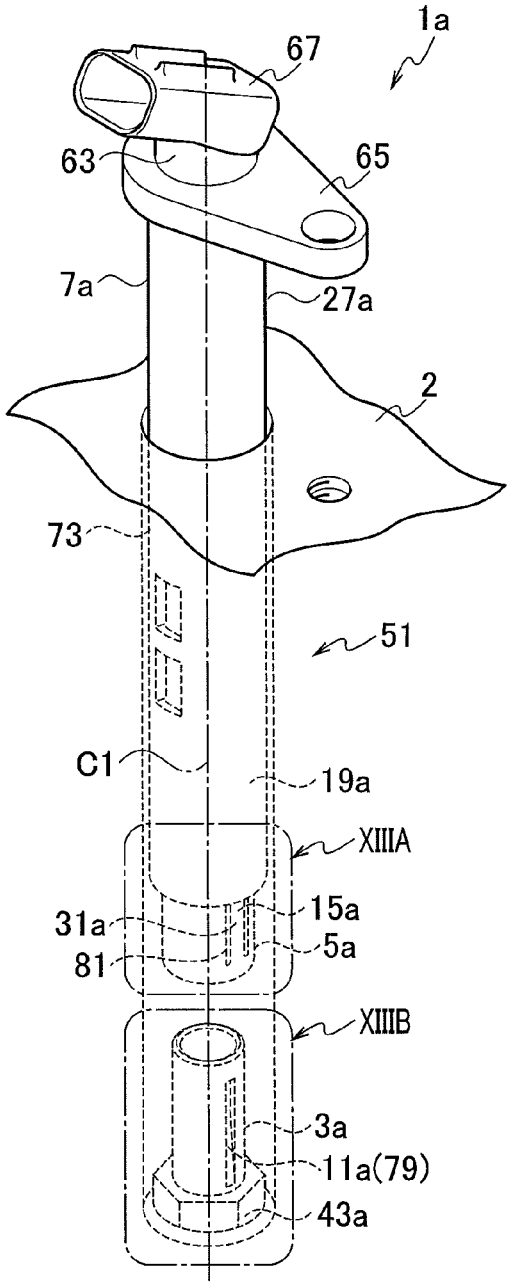
FIG. 12A is a perspective view illustrating a state in which the connector according to the second embodiment is installed in the cylinder head, and is a view illustrating a state in which the first connector constituent is installed in the cylinder head and the second connector constituent and the third connector constituent are spaced away from the first connector constituent.
Figure 12B:
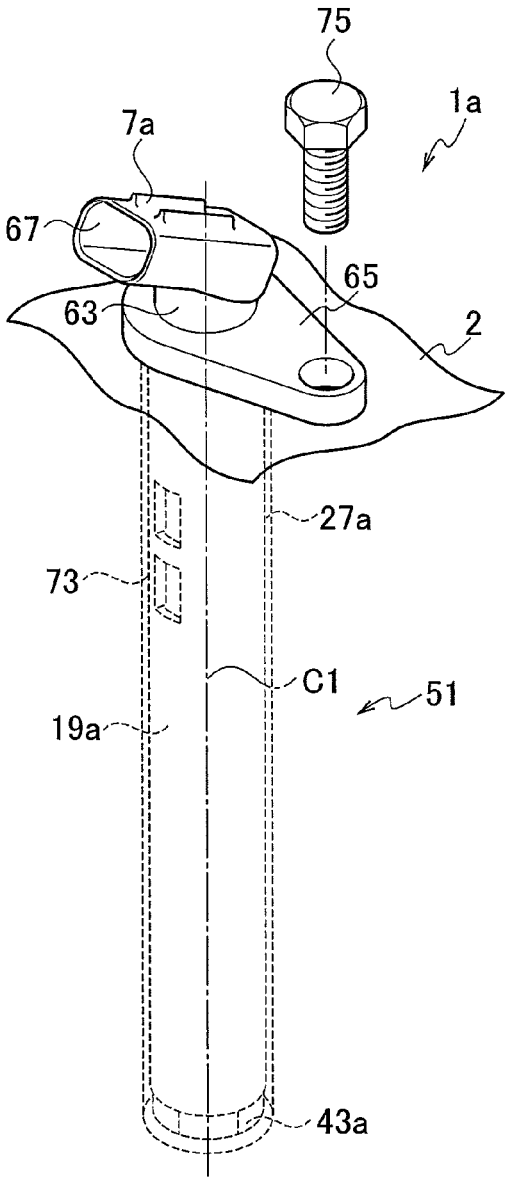
FIG. 12B is a perspective view illustrating a state in which the connector according to the second embodiment is installed in the cylinder head, and is a view illustrating a state in which the first connector constituent is installed in the cylinder head and the second connector constituent and the third connector constituent are installed in the first connector constituent.
Figure 13A:
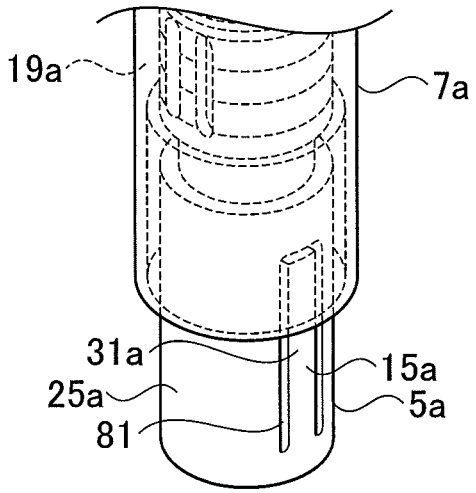
FIG. 13A is an enlarged view of a part XIIIA of FIG. 12A.
Figure 13B:
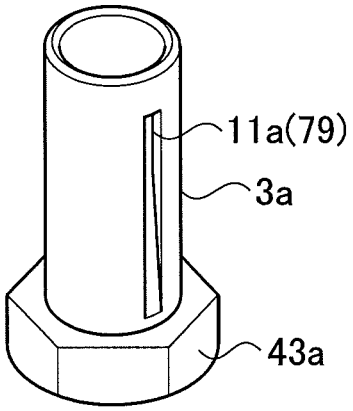
FIG. 13B is an enlarged view of a part XIIIB of FIG. 12A.
Figure 14:
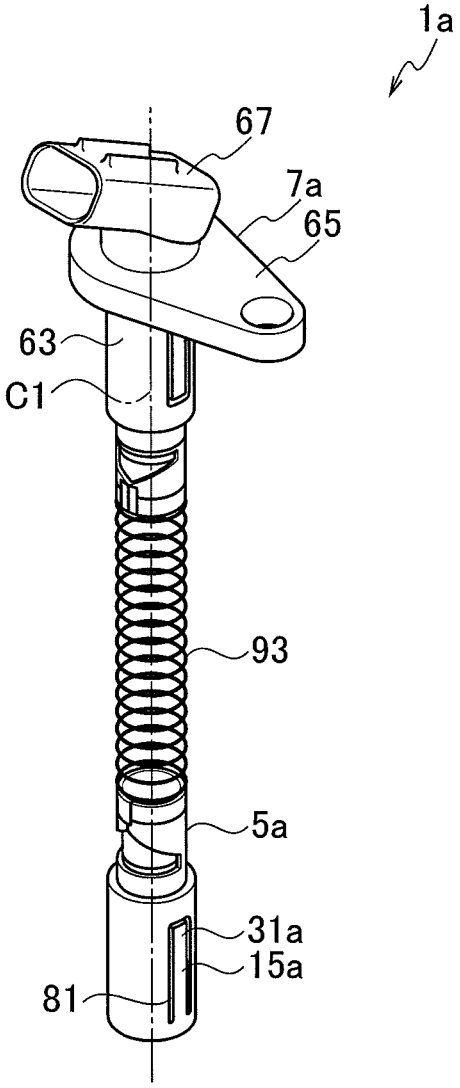
FIG. 14 is a perspective view of the connector according to the second embodiment, and is a view omitting illustration of a rotating member and a cylindrical portion of the third connector constituent.
Figure 15:
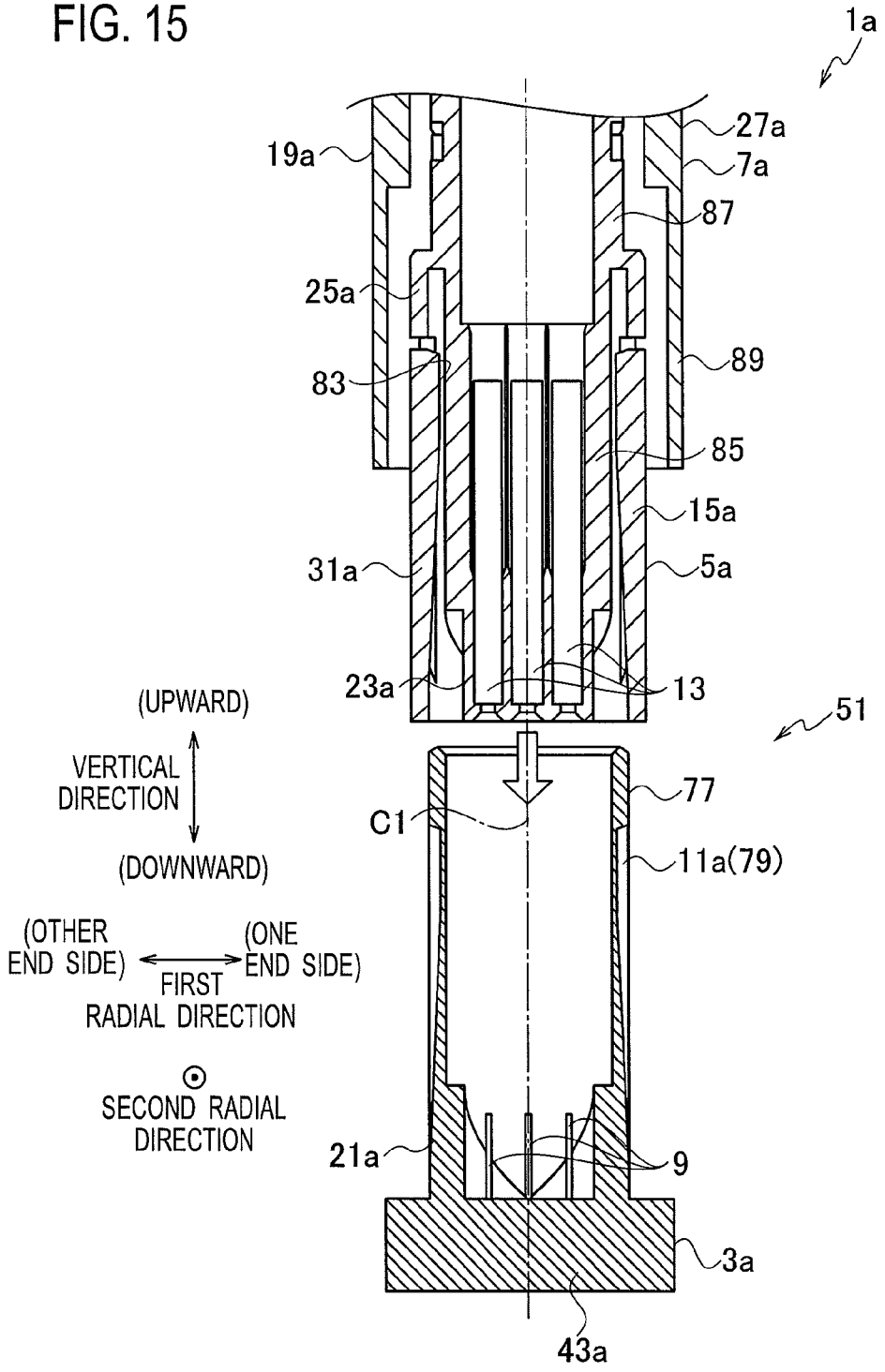
FIG. 15 is a view illustrating a state in which the second connector constituent and the third connector constituent are in process of being installed in the first connector constituent of the connector according to the second embodiment.

In an initial state, as illustrated in FIGS. 10 and 15, the second connector constituent 5*a*, the third connector constituent 7*a* and the rotating member 91 are integral with one another, and this integral construction is located over the first connector constituent 3*a* apart from the first connector constituent 3*a*. Also, it is assumed that in the initial state, the central axes C1 of the connector constituents 3*a*, 5*a*, 7*a* coincide with one another.

In such an initial state, the second connector constituent 5*a* and the third connector constituent 7*a* are moved downward. Then, by the rotational positioning portion 51, the rotating member 91 of the second connector constituent 5*a* appropriately rotates relative to the first connector constituent 3*a*, about the central axis C1. Thus, the second connector constituent 5*a* reaches the normal position of fitting rotation relative to the first connector constituent 3*a*.

Then, when the second connector constituent 5*a* and the third connector constituent 7*a* are further moved downward, as illustrated in FIG. 16, the upper end of the second cylindrical portion 77 of the first connector constituent 3*a* enters the lower end of the second cylindrical portion 25*a* of the second connector constituent 5*a*, and start fitting.

When the second connector constituent 5*a* and the third connector constituent 7*a* are further moved downward, as illustrated in FIGS. 17 to 19, the above-described fitting further proceeds, and the elastic arm 31*a* is elastically deformed outward by being pressed by the first connector constituent 3*a*. Also, as illustrated in FIG. 19, the lower end of the first cylindrical portion 27*a* of the third connector constituent 7*a* abuts the upper end of the elastic arm 31*a*.

Then, when the second connector constituent 5*a* and the third connector constituent 7*a* are further moved downward, as illustrated in FIG. 20, the elastic arm 31*a* is restored to its original state, and the portion 83 of the elastic arm 31*a* enters the recess portion 79 of the first connector constituent 3*a*, so that the locked portion 15*a* is locked to the locking portion 11*a*. Thus, the installation of the second connector constituent 5*a* over the first connector constituent 3*a* is finished.

Then, when the third connector constituent 7*a* is further moved downward, as illustrated in FIG. 21, the locked-portion holding portion 19*a* of the lower end portion of the first cylindrical portion 27*a* of the third connector constituent 7*a* engages the restored elastic arm 31*a* and covers the elastic arm 31*a*. Thus, the locked-portion holding portion 19*a* engages locked portion 15*a*, so that the elastic arm 31*a* does not become deformed.

Then, in order to adjust the orientation of the third terminal 17, appropriate rotational positioning of the third connector constituent 7*a* relative to the second connector constituent 5*a* takes place, and the third connector constituent 7*a* is fixed to the cylinder head 2 by using the bolt 75. Thus, the cylinder head 2, the first connector constituent 3*a*, the second connector constituent 5*a* and the third connector constituent 7*a* are integrally formed by a strong force.

Note that the compression coil spring 93 is more contracted than that in the initial state, when the second connector constituent 5*a* and the like are installed over the first connector constituent 3*a* and when such installation has been finished.

According to the connector 1*a* according to the second embodiment, the elastic arm 31*a* is configured to be elastically deformed outward under a condition where the second connector constituent 5*a* is in process of being installed over the first connector constituent 3*a*, and the elastic arm 31*a* is configured to be restored to its original state under a condition where the installation of the second connector constituent 5*a* over the first connector constituent 3*a* has been finished. Thus, behavior of the elastic arm 31*a* can be manually conceived, and an operator can easily recognize that the installation of the second connector constituent 5*a* over the first connector constituent 3*a* has been finished.

According to the connector 1*a* according to the second embodiment, moreover, by biasing by the compression coil spring 93, the second connector constituent 5*a* is biased toward and connected to the first connector constituent 3*a*. Thus, the vibration resistance and the electrical contact characteristics are further improved.

Note that in the above description, under no external force applied, the portion 83 of the elastic arm 31*a* slightly protrudes inward, and the elastic arm 31*a* is configured to be elastically deformed outward under a condition where the second connector constituent 5*a* is in process of being installed over the first connector constituent 3*a*, and the elastic arm 31*a* is configured to be restored to its original state under a condition where the installation of the second connector constituent 5*a* over the first connector constituent 3*a* has been finished, and the portion 83 protruding inward of the elastic arm 31*a* enters the recess portion 79 which forms the locking portion 11*a* so that the locked portion 15*a* is locked to the locking portion 11*a*; however, such a configuration is not necessarily required.

For example, the following configuration may be adopted; specifically, under no external force applied, the elastic arm is not bent inward, and under a condition where the second connector constituent 5*a* is in process of being installed in the first connector constituent 3*a*, the portion of the elastic arm does not protrude inward, and under a condition where the second connector constituent 5*a* is in process of being installed in the first connector constituent 3*a*, the elastic arm is not elastically deformed, and at the completion of the installation of the third connector constituent 7*a* over the preinstalled second connector constituent 5*a*, the elastic arm is elastically deformed inward by being pressed by the locked-portion holding portion 19*a*, and the locked portion (or the inside portion of the elastic arm) enters the locking portion so that locked portion is locked to the locking portion.

In the connector 1 according to the first embodiment, moreover, as is the case with the connector 1*a* according to the second embodiment, a compression coil spring may be disposed between the second connector constituent 5 and the third connector constituent 7 (or within the cylindrical portion 27 of the third connector constituent 7 and also between the second connector constituent 5 and the bottom wall portion 61 of the third connector constituent 7) so as to bias the second connector constituent 5 downward.

As described above, it is possible to provide a connector including a first connector constituent including a first terminal and a locking portion, and a second connector constituent including a second terminal and a locked portion, and configured so that the second terminal is joined to the first terminal when the second connector constituent is installed in the first connector constituent, in which under a condition where the second connector constituent is installed in the first connector constituent, the connector constituents are not easily disjoined from each other thereby to enable ensuring the fitting together of connector portions.

In this way, the present invention includes various embodiments not described above. Therefore, the scope of the present invention is determined only by the invention identification matters according to claims reasonable from the foregoing description.

What is claimed is:

1. A connector comprising:

a first connector constituent including a first terminal and a locking portion;

a second connector constituent including a second terminal and a locked portion, and configured so that the second terminal is joined to the first terminal when the second connector constituent is installed in the first connector constituent;

a third connector constituent including a third terminal and a locked-portion holding portion configured to keep the locked portion locked to the locking portion, and to keep the first terminal contacted to the second terminal when the third connector constituent is installed over the second connector constituent installed in the first connector constituent; and a compression coil spring, wherein the compression coil spring is provided within a first cylindrical portion of the third connector constituent and between a body portion of the third connector constituent and the second connector constituent, and the compression coil spring biases the second connector constituent downward.

2. The connector according to claim 1, wherein the first connector constituent further includes a first cylindrical portion inside of which the first terminal is provided, the second connector constituent further includes a first cylindrical portion inside of which the second terminal is provided, an inside diameter of the first cylindrical portion of the first connector constituent is slightly larger than an outside diameter of the first cylindrical portion of the second connector constituent, and under a condition where the second connector constituent is installed in the first connector constituent, the first cylindrical portion of the second connector constituent enters the inside of the first cylindrical portion of the first connector constituent so that the first cylindrical portions are fitted to each other.

3. The connector according to claim 2, wherein the second connector constituent further includes a second cylindrical portion having an outside diameter smaller than the inside diameter of the first cylindrical portion of the first connector constituent, the third connector constituent further includes a cylindrical portion having an outside diameter slightly smaller than the inside diameter of the first cylindrical portion of the first connector constituent, and having an inside diameter slightly larger than the outside diameter of the second cylindrical portion of the second connector constituent, the locking portion is formed of any one of a recess portion and a through-hole provided in the first cylindrical portion of the first connector constituent, the locked portion includes an elastic arm and a locked claw, the elastic arm is formed in a cantilever shape by providing a cutout to the second cylindrical portion of the second connector constituent, the elastic arm is bent inward under no external force applied, the locked claw is formed in such a way as to protrude and turn back from a distal end of the elastic arm outward of the second cylindrical portion of the second connector constituent, a portion formed by the turn-back is spaced away from the elastic arm at a predetermined distance therefrom, a portion of the cylindrical portion of the third connector constituent forms the locked-portion holding portion, and under a condition where the third connector constituent is installed over the second connector constituent installed in the first connector constituent, the cylindrical portion of the third connector constituent enters the inside of the first cylindrical portion of the first connector constituent, and the second cylindrical portion of the second connector constituent enters the inside of the cylindrical portion of the third connector constituent, and the locked-portion holding portion enters between the elastic arm and the portion formed by the turn-back of the locked claw to deform the elastic arm and to cause the portion formed by the turn-back of the locked claw to enter the locking portion, so that the locked portion is kept locked to the locking portion.

4. The connector according to claim 2, wherein the first connector constituent further includes a second cylindrical portion, the second connector constituent further includes a second cylindrical portion having an inside diameter slightly larger than an outside diameter of the second cylindrical portion of the first connector constituent, the third connector constituent further includes a cylindrical portion having an inside diameter slightly larger than an outside diameter of the second cylindrical portion of the second connector constituent, the locking portion is formed of any one of a recess portion and a through-hole provided in the second cylindrical portion of the first connector constituent, the locked portion further includes an elastic arm, the elastic arm is formed in a cantilever shape by providing a cutout to the second cylindrical portion of the second connector constituent, a portion of the elastic arm slightly protrudes inward, a portion of the cylindrical portion of the third connector constituent forms the locked-portion holding portion, under a condition where the second connector constituent is in process of being installed over the first connector constituent, the elastic arm is elastically deformed by being pressed by the second cylindrical portion of the first connector constituent, after installation of the second connector constituent over the first connector constituent is completed, the elastic arm is restored to its original state, and the portion protruding inward of the elastic arm enters the locking portion, so that the locked portion is locked to the locking portion, and after installation of the third connector constituent over the second connector constituent installed over the first connector constituent is completed, the second cylindrical portion of the first connector constituent enters the inside of the second cylindrical portion of the second connector constituent, the second cylindrical portion of the second connector constituent enters the inside of the cylindrical portion of the third connector constituent, and the elastic arm enters the inside of the locked-portion holding portion, so that the locked portion is kept locked to the locking portion.

5. The connector according to claim 1, wherein the second connector constituent further includes a second cylindrical portion having an outside diameter smaller than the inside diameter of the first cylindrical portion of the first connector constituent, the third connector constituent further includes a cylindrical portion having an outside diameter slightly smaller than the inside diameter of the first cylindrical portion of the first connector constituent, and having an inside diameter slightly larger than the outside diameter of the second cylindrical portion of the second connector constituent, the locking portion is formed of any one of a recess portion and a through-hole provided in the first cylindrical portion of the first connector constituent, the locked portion includes an elastic arm and a locked claw, the elastic arm is formed in a cantilever shape by providing a cutout to the second cylindrical portion of the second connector constituent, the elastic arm is bent inward under no external force applied, the locked claw is formed in such a way as to protrude and turn back from a distal end of the elastic arm outward of the second cylindrical portion of the second connector constituent, a portion formed by the turn-back is spaced away from the elastic arm at a predetermined distance therefrom, a portion of the cylindrical portion of the third connector constituent forms the locked-portion holding portion, and under a condition where the third connector constituent is installed over the second connector constituent installed in the first connector constituent, the cylindrical portion of the third connector constituent enters the inside of the first cylindrical portion of the first connector constituent, and the second cylindrical portion of the second connector constituent enters the inside of the cylindrical portion of the third connector constituent, and the locked-portion holding portion enters between the elastic arm and the portion formed by the turn-back of the locked claw to deform the elastic arm and to cause the portion formed by the turn-back of the locked claw to enter the locking portion, so that the locked portion is kept locked to the locking portion.

6. The connector according to claim 5 wherein the cutout comprises a pair of cutouts that extend longitudinally in a direction of extension of a central axis of the second cylindrical portion of the second connector constituent, the pair of cutouts are spaced apart with a slight gap in a peripheral direction of the second cylindrical portion of the second connector constituent, and extend through a heavy portion of the second cylindrical portion of the second connector constituent.

7. The connector according to claim 1, wherein the first connector constituent further includes a second cylindrical portion, the second connector constituent further includes a second cylindrical portion having an inside diameter slightly larger than an outside diameter of the second cylindrical portion of the first connector constituent, the third connector constituent further includes a cylindrical portion having an inside diameter slightly larger than an outside diameter of the second cylindrical portion of the second connector constituent, the locking portion is formed of any one of a recess portion and a through-hole provided in the second cylindrical portion of the first connector constituent, the locked portion further includes an elastic arm, the elastic arm is formed in a cantilever shape by providing a cutout to the second cylindrical portion of the second connector constituent, a portion of the elastic arm slightly protrudes inward, a portion of the cylindrical portion of the third connector constituent forms the locked-portion holding portion, under a condition where the second connector constituent is in process of being installed over the first connector constituent, the elastic arm is elastically deformed by being pressed by the second cylindrical portion of the first connector constituent, after installation of the second connector constituent over the first connector constituent is completed, the elastic arm is restored to its original state, and the portion protruding inward of the elastic arm enters the locking portion, so that the locked portion is locked to the locking portion, and after installation of the third connector constituent over the second connector constituent installed over the first connector constituent is completed, the second cylindrical portion of the first connector constituent enters the inside of the second cylindrical portion of the second connector constituent, the second cylindrical portion of the second connector constituent enters the inside of the cylindrical portion of the third connector constituent, and the elastic arm enters the inside of the locked-portion holding portion, so that the locked portion is kept locked to the locking portion.

8. The connector according to claim 1, wherein the first connector constituent comprises a male connector, the second connector constituent comprises a female connector, and the third connector constituent comprises a wire harness-side male connector formed of plural male terminals.

9. The connector according to claim 8, wherein the second connector constituent is installed in the first connector constituent such that the male connector of the first connector constituent is joined to the female connector of the second connector constituent.

10. The connector according to claim 1, wherein the third connector constituent is installed over the second connector constituent in a condition in which the second connector constituent is preinstalled, and thereby, the locked portion is locked to the locking portion.

* * * * *